US011384599B2

(12) United States Patent
Tao

(10) Patent No.: US 11,384,599 B2
(45) Date of Patent: Jul. 12, 2022

(54) ROLLER BLIND AND CONTROL DEVICE THEREOF

(71) Applicant: CSL SUNMASTER ENTERPRISES CO., LTD., Kaohsiung (TW)

(72) Inventor: Yi-Chin Tao, Kaohsiung (TW)

(73) Assignee: CSL Sunmaster Enterprises Co., Ltd., Kaohsiung (TW)

( * ) Notice: Subject to any disclaimer, the term of this patent is extended or adjusted under 35 U.S.C. 154(b) by 125 days.

(21) Appl. No.: 16/690,355

(22) Filed: Nov. 21, 2019

(65) Prior Publication Data

US 2021/0156196 A1 May 27, 2021

(51) Int. Cl.

| | |
|---|---|
| ***E06B 9/72*** | (2006.01) |
| ***A47H 5/03*** | (2006.01) |
| ***E06B 9/88*** | (2006.01) |
| *E06B 9/80* | (2006.01) |
| *E06B 9/68* | (2006.01) |

(52) U.S. Cl.

CPC ..... *E06B 9/72* (2013.01); *A47H 5/03* (2013.01); *E06B 9/88* (2013.01); *E06B 2009/6809* (2013.01); *E06B 2009/802* (2013.01)

(58) Field of Classification Search

CPC ..... E06B 9/72; E06B 9/68; E06B 9/88; E06B 2009/6809; E06B 2009/802; E06B 9/322; E06B 9/90; A47H 5/03

See application file for complete search history.

(56) References Cited

U.S. PATENT DOCUMENTS

| | | | | |
|---|---|---|---|---|
| 5,375,643 | A * | 12/1994 | Rude | E06B 9/90 160/321 |
| 6,164,428 | A | 12/2000 | Berman et al. | |
| 9,353,570 | B2 * | 5/2016 | Smith | E06B 9/38 |
| 2015/0136342 | A1 * | 5/2015 | Clements | F16D 27/02 160/368.1 |
| 2015/0376941 | A1 * | 12/2015 | Fujita | E06B 9/60 160/241 |
| 2017/0226799 | A1 * | 8/2017 | Hebeisen | E06B 9/50 |

FOREIGN PATENT DOCUMENTS

| | | |
|---|---|---|
| TW | M318394 | 9/2006 |
| WO | 2015074068 A1 | 5/2015 |

OTHER PUBLICATIONS

Examination and Search Report for European Counterpart Application No. 19210853.8, dated May 26, 2020.

* cited by examiner

*Primary Examiner* — Johnnie A. Shablack
*Assistant Examiner* — Matthew R. Shepherd
(74) *Attorney, Agent, or Firm* — Rosenberg, Klein & Lee

(57) ABSTRACT

The present invention relates to a roller blind and a control device thereof. The control device comprises a reeling mechanism, a solenoid valve, a push mechanism, a front cap, and a damper. After the solenoid valve is energized, the solenoid valve drives the push mechanism to push against the front cap so as to separate the front cap from an engaging portion of the reeling mechanism, and the reeling mechanism is not subject to a resistance of the damper. A curtain fabric is not affected by the resistance of the damper and can be quickly lowered by gravity.

10 Claims, 24 Drawing Sheets

ROLLER BLIND AND CONTROL DEVICE THEREOF

FIELD OF THE INVENTION

The present invention relates to a roller blind and a control device thereof, and more particularly to a roller blind that can lower a curtain fabric quickly and a control device thereof.

BACKGROUND OF THE INVENTION

Roller blinds installed inside buildings, such as shutters, window curtains or door curtains that can be rolled up and down, are used to shield sights from outside the building, preventing persons in the building from being discovered or being peeked.

Taiwan Utility Model Publication No. M318394 discloses a self-descending controller for window curtains, which is wrapped by a casing and comprises a chain gear, a clutch, a flat wire spring, a sleeve, a worm gear, and a worm. A plurality of fan blades protrude outward from a circumferential surface of the right end of the chain gear, and a bushing is formed at the left end of the chain gear. The clutch is disposed in the bushing. Two symmetrical protrusions on the inner wall of the bushing at the left end of the chain gear are matched with a rotating thread on the outer wall of the clutch, so that the protrusions can be moved on the thread. The flat wire spring is mounted in the right end of the sleeve. The spindle at the right end of the worm gear is configured to position the above device. The gear-shaped boss at the top of the clutch is meshed with the boss at the end of the spindle of the worm wheel. The worm is connected to the bushing of the worm. Through a connecting member, a positioning pin and a worm shaft seat, the worm is fixed on a worm shaft seat groove of the housing. Then, the entire worm assembly is placed in the worm shaft seat groove in the housing, so that the worm gear is meshed with the worm. During the descent, there is no phenomenon that the curtain is unbalanced because the user pulls the bead chain inappropriately. The curtain can automatically lower. There is no need for the operator to continue to pull the bead chain. However, in the aforementioned patent, when it is necessary to lower the curtain quickly, the curtain is decelerated because the worm gear is meshed with the worm. Thus, the curtain cannot be quickly lowered.

Accordingly, the inventor of the present invention has devoted himself based on his many years of practical experiences to solve these problems.

SUMMARY OF THE INVENTION

According to one aspect of the present invention, a control device of a roller blind is provided. The control device comprises a reeling mechanism, having an engaging portion; a solenoid valve, disposed in the reeling mechanism; a push mechanism, movably disposed on the reeling mechanism, the push mechanism being connected with the solenoid valve; a front cap, engaged with the engaging portion of the reeling mechanism, the front cap being connected with the push mechanism; and a damper, disposed in the reeling mechanism. Wherein, after the solenoid valve is energized, the solenoid valve drives the push mechanism to push against the front cap so as to separate the front cap from the engaging portion, and the reeling mechanism is not subject to a resistance of the damper.

Preferably, the reeling mechanism includes a reeling wheel, an inner cylinder, and an outer cylinder. The reeling wheel has an action portion connected to the inner cylinder. The engaging portion includes a first engaging portion disposed on the inner cylinder and a second engaging portion disposed on the outer cylinder. The inner cylinder and the outer cylinder are detachably engaged with the front cap through the first engaging portion and the second engaging portion.

Preferably, the control device further comprises a fixing seat. The damper is a first elastic member. The first elastic member is tightly sleeved on the fixing seat. The first elastic member has a protruding portion. The action portion of the reeling wheel is an extension piece. The extension piece extends into the inner cylinder. The inner cylinder has a blocking portion corresponding to the extension piece. An operation space is defined between the blocking portion and the extension piece. The protruding portion of the first elastic member extends into the operation space. Through the extension piece to push against the protruding portion of the first elastic member, the first elastic member can be released from the fixing seat.

Preferably, the first engaging portion of the inner cylinder is a protrusion. The protrusion is detachably engaged in an engaging groove of the front cap.

Preferably, the second engaging portion of the outer cylinder is a plurality of raised blocks. The plurality of raised blocks are detachably engaged with a plurality of engaging blocks of the front cap.

Preferably, the push mechanism includes a shaft, a second elastic member, and a screw. The second elastic member is disposed on the shaft. The shaft is connected with the solenoid valve. The shaft is locked to the front cap by the screw. The fixing seat has a retaining wall corresponding to the second elastic member. When the solenoid valve is energized, the shaft is controlled to extend out, so that the front cap is pushed by the shaft to be separated from the reeling mechanism, and the second elastic member abuts against the retaining wall to be compressed and store an elastic potential energy. After the solenoid valve is powered off, the second elastic member releases the elastic potential energy to return the shaft, and the front cap is engaged with the reeling mechanism.

Preferably, the control device further comprises a fixing seat. The solenoid valve is disposed in the fixing seat.

According to another aspect of the present invention, a roller blind is provided. The roller blind comprises a linkage assembly, including an outer tube connected with a curtain fabric; and a control device, disposed at one end of the outer tube and engaged with the outer tube. The control device comprises a reeling mechanism, having an engaging portion; a solenoid valve, disposed in the reeling mechanism; a push mechanism, movably disposed on the reeling mechanism, the push mechanism being connected with the solenoid valve; a front cap, engaged with the engaging portion of the reeling mechanism, the front cap being connected with the push mechanism; and a damper, disposed in the reeling mechanism. Wherein, after the solenoid valve is energized, the solenoid valve drives the push mechanism to push against the front cap so as to separate the front cap from the engaging portion, and the reeling mechanism is not subject to a resistance of the damper to drive the outer tube to rotate so as to lower the curtain fabric.

Preferably, the roller blind further comprises an outer rod disposed in the outer tube and a limiting mechanism disposed on the outer rod and engaged with the outer tube. The limiting mechanism includes an inner tube sleeved on one end of the outer rod, a slider and a limiting seat that are rotationally movable in the inner tube. The slider has a first threaded portion. The inner tube has a second threaded portion. The first threaded portion of the slider is meshed with the second threaded portion of the inner tube. The outer tube has a limiting rib located in a limiting portion of the slider. When the outer tube is rotated to lower the curtain fabric, the outer tube drives the slider to rotate and move on the inner tube along the limiting rib in cooperation with the second threaded portion. When the slider is pushed against the limiting seat, the slider drives the outer tube to stop rotating.

Preferably, the slider is a first slider. The limiting seat includes a second slider and a buffer elastic member. The buffer elastic member is disposed between the inner tube and the second slider. When the first slider is pushed against the second slider, the buffer elastic member stores a buffer elastic potential energy, so that the second slider stops rotating. When the first slider is moved away from the second slider, the buffer elastic member releases the buffer elastic potential energy to return the second slider.

Preferably, the slider has a first coupling portion. The limiting seat has a second coupling portion. When the slider is pushed against the limiting seat, the first coupling portion is coupled to the second coupling portion.

Preferably, the roller blind further comprises a tail seat disposed at another end of the outer tube. An inner rod is disposed in the tail seat. The inner rod is connected with the outer rod. When an operation portion of the inner rod is operated to rotate the inner rod, the inner rod drives the outer rod to rotate relative to the outer tube, so that the slider is rotationally moved on the inner tube to adjust a distance between the slider and the limiting seat.

Preferably, the inner rod includes a first coupling member. A second coupling member is disposed on the tail seat. A return elastic member is sleeved on the inner rod. When the first coupling member of the inner rod is disengaged from the second coupling member of the tail seat by operating the operation portion, the return elastic member stores a return elastic potential energy, and the inner rod drives the outer rod to rotate relative to the outer tube. When the operation portion is released, the return elastic member releases the return elastic potential energy to return the inner rod, so that the first coupling member of the inner rod is engaged with the second coupling member.

Preferably, the second coupling member is coupled to the tail seat by a C-shaped retaining ring.

Preferably, the roller blind further comprises a first sleeve disposed in the outer tube and engaged with the outer tube. A tail seat is disposed at another end of the outer tube. An adjustment member and a second sleeve are disposed on the tail seat. A brake elastic member is tightly sleeved on the tail seat. An auxiliary elastic member is connected to the first sleeve and the second sleeve. When the adjustment member is rotated, the adjustment member is pushed against a brake protruding portion of the brake elastic member so that the brake elastic member is released from the tail seat, the adjustment member drives the second sleeve to rotate relative to the first sleeve, and the auxiliary elastic member stores an auxiliary elastic potential energy. When the adjustment member stops rotating, the second sleeve is pushed against the brake protruding portion, and the brake elastic member is tightly sleeved on the tail seat so that auxiliary elastic member maintains the auxiliary elastic potential energy.

According to the above technical features, the following effects can be achieved:

1. After the solenoid valve is energized, the front cap is separated from the engaging portion of the reeling mechanism, the reeling mechanism is free from the resistance of the first elastic member, and the curtain fabric can be quickly lowered by gravity.

2. When the curtain fabric is in urgent need to be pulled down for hiding, the user only needs to energize the solenoid valve to disengage the front cap from the engaging portion of the reeling mechanism, thereby lowering the curtain fabric. There is no need for the user to approach the door/window where the curtain fabric is located for operating the reeling wheel, reducing the risk of being discovered.

3. When the reeling wheel is used to lower or roll up the curtain fabric, the extension piece pushes against the protruding portion of the first elastic member, so that the first elastic member is released from the fixing seat to rotate relative to the fixing seat, and the reeling mechanism can rotate to lower or roll up the curtain fabric.

4. The protrusion of the inner cylinder and the raised blocks of the outer cylinder are detachably engaged in the engaging groove and between the engaging blocks of the front cap, respectively. After the reeling wheel pulls the curtain fabric and the inner cylinder is driven by the reeling wheel, the outer cylinder and the front cap are linked by the inner cylinder to lower and roll up the curtain fabric.

5. When the reeling wheel stops pulling the curtain fabric, the blocking portion of the inner cylinder pushes against the protruding portion of the first elastic member, so that the first elastic member is tightly sleeved on the fixing seat again. The first elastic member does not rotate relative to the fixing seat, so that the curtain fabric is positioned without falling down.

6. After the curtain fabric is lowered, the limiting mechanism is configured to restrain the curtain fabric, preventing the curtain fabric from lowering excessively.

7. Through the buffer elastic member, the impact force when the curtain fabric is restrained can be reduced, avoiding the excessive impact force to damage the limiting mechanism.

8. The first coupling portion of the slider and the second coupling portion of the limiting seat can surely maintain the limiting state, and the buffer elastic member can avoid the situation that the slider is still rotated in the original position and cannot be surely restrained.

9. By operating the operation portion of the inner rod with a tool, the distance between the slider and the limiting seat can be adjusted, thereby allowing the curtain fabric to be restrained at a desired height.

10. The return elastic member cooperates with the first coupling member and the second coupling member to retain the inner rod, so that the inner rod does not rotate any more, and the distance after adjusted can be kept.

11. The gear can adjust the tightness of the auxiliary elastic member and can be retained by the brake elastic member, so that the user can adjust the appropriate elastic force of the auxiliary elastic member according to the weight of the curtain fabric.

DETAILED DESCRIPTION OF THE PREFERRED EMBODIMENTS

Embodiments of the present invention will now be described, by way of example only, with reference to the accompanying drawings.

Figure 1:
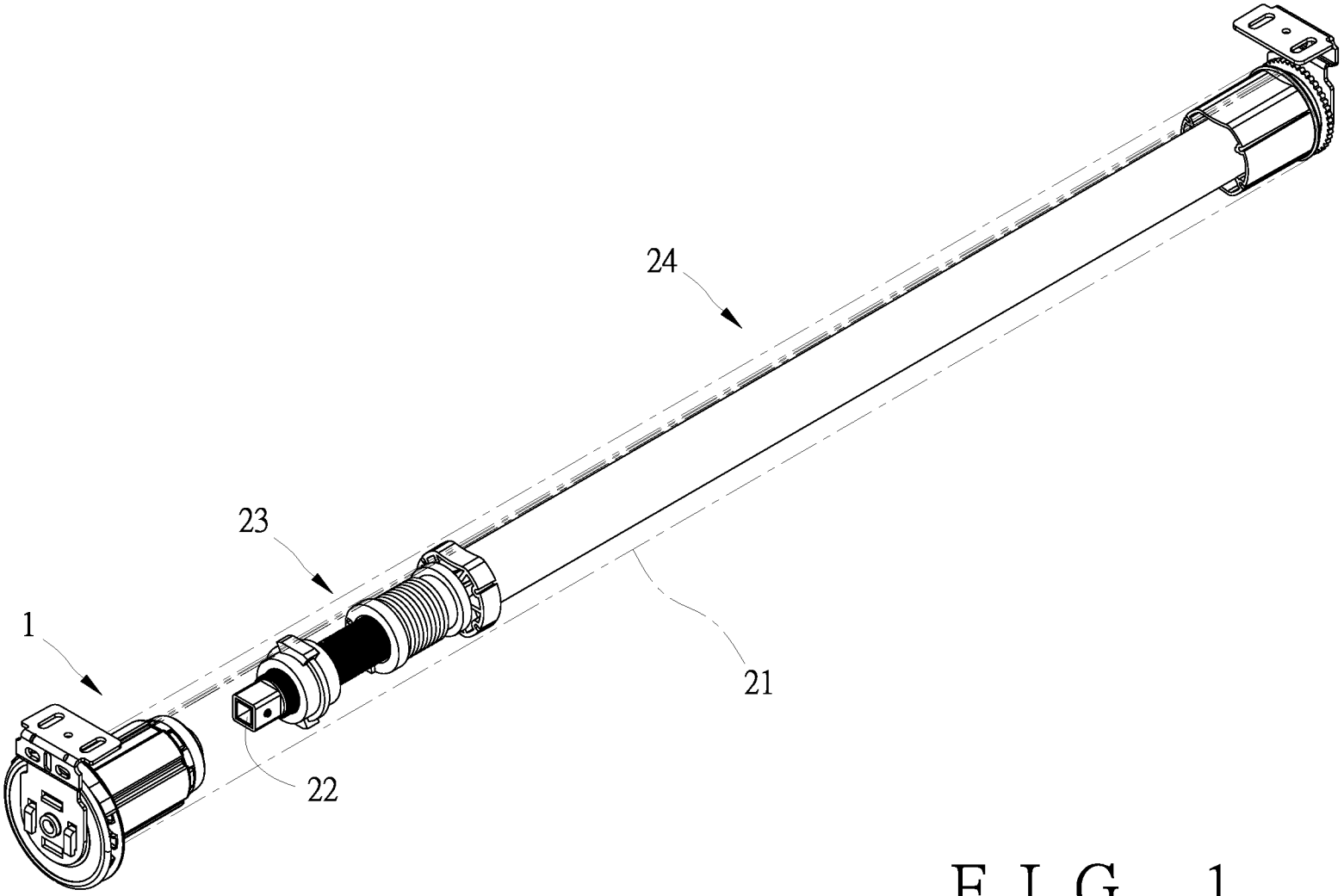
FIG. 1 is a perspective view of the roller blind of the present invention.
Figure 2:
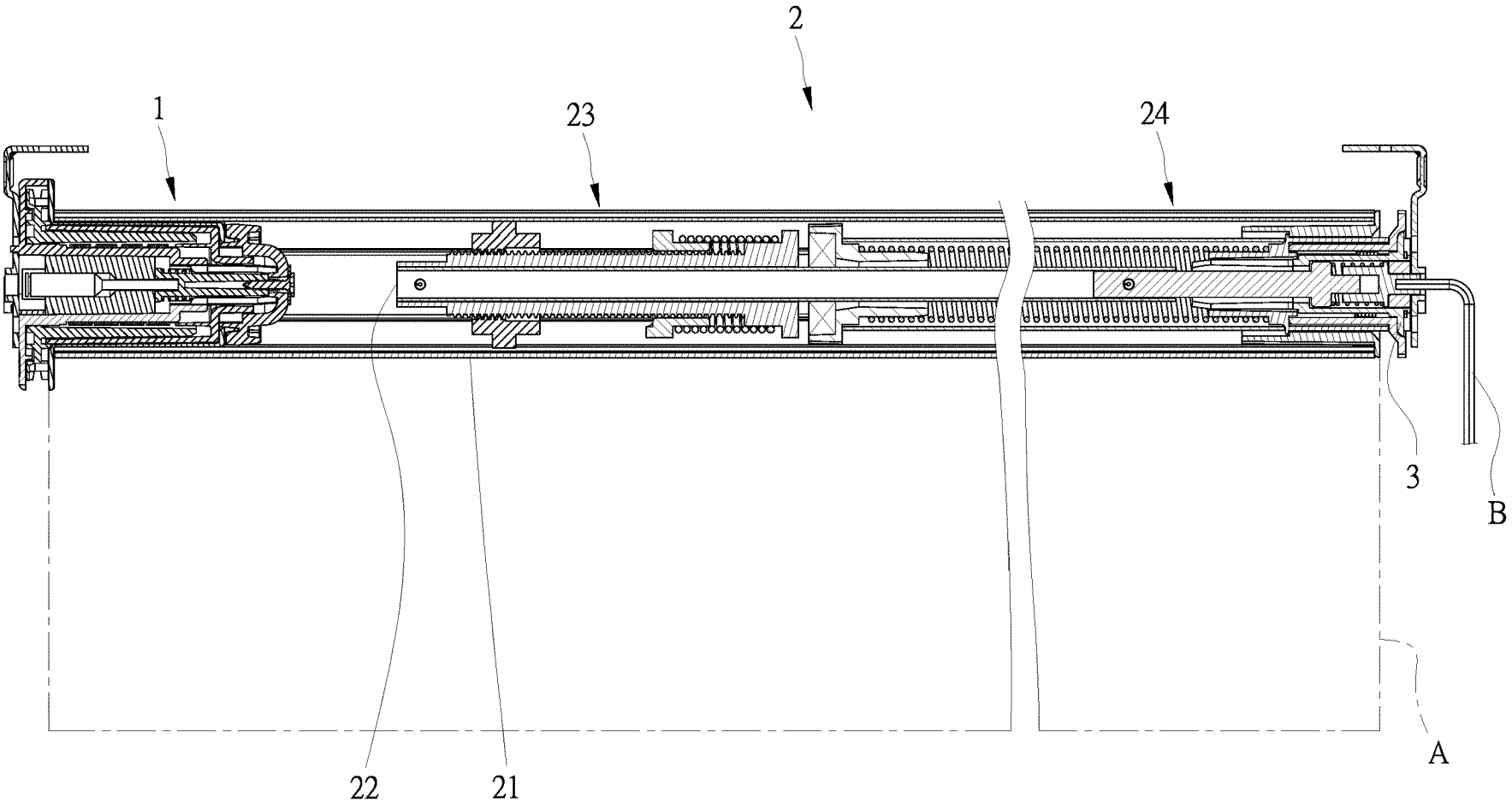
FIG. 2 is a cross-sectional view of the roller blind of the present invention.

Referring to FIG. 1 and FIG. 2, the present invention discloses a roller blind that can lower a curtain fabric (A) quickly. The roller blind comprises a control device (1), a linkage assembly (2), and a tail seat (3). The control device (1) is disposed at one end of the linkage assembly (2) and engaged with the linkage assembly (2). The tail seat (3) is disposed at another end of the linkage assembly (2). In detail, the linkage assembly (2) includes an outer tube (21), an outer rod (22), a limiting mechanism (23), and an adjustment mechanism (24). The outer tube (21) is connected with the curtain fabric (A). The control device (1) is engaged with the outer tube (21). The outer rod (22) is disposed in the outer tube (21). The limiting mechanism (23) is disposed at one end of the outer rod (22), and the adjustment mechanism (24) is disposed at another end of the outer rod (22). The limiting mechanism (23) is disposed on the outer rod (22) and engaged with the outer tube (21). The adjustment mechanism (24) is disposed in the tail seat (3).

Figure 3:
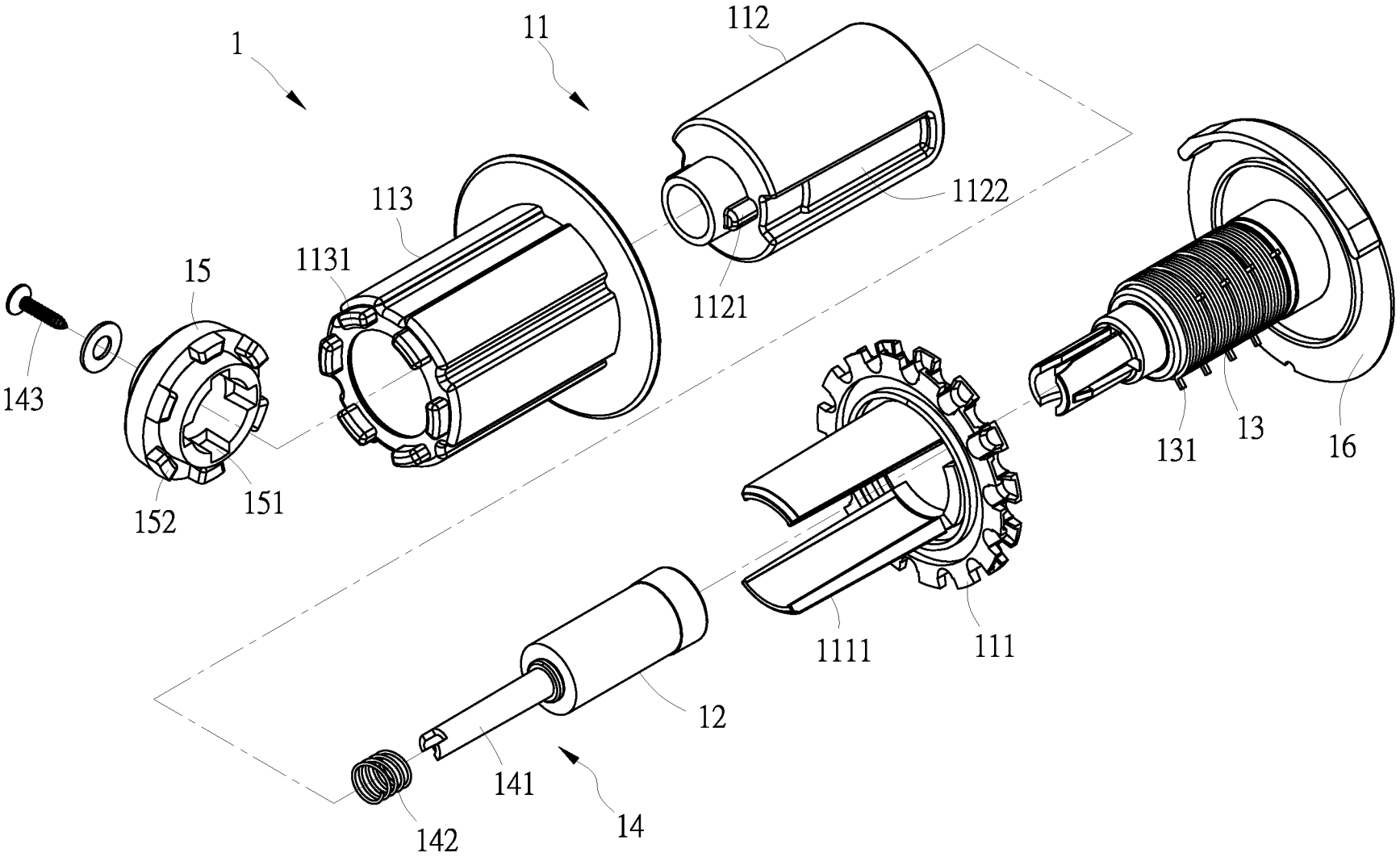
FIG. 3 is an exploded view of the control device of the present invention.
Figure 4:
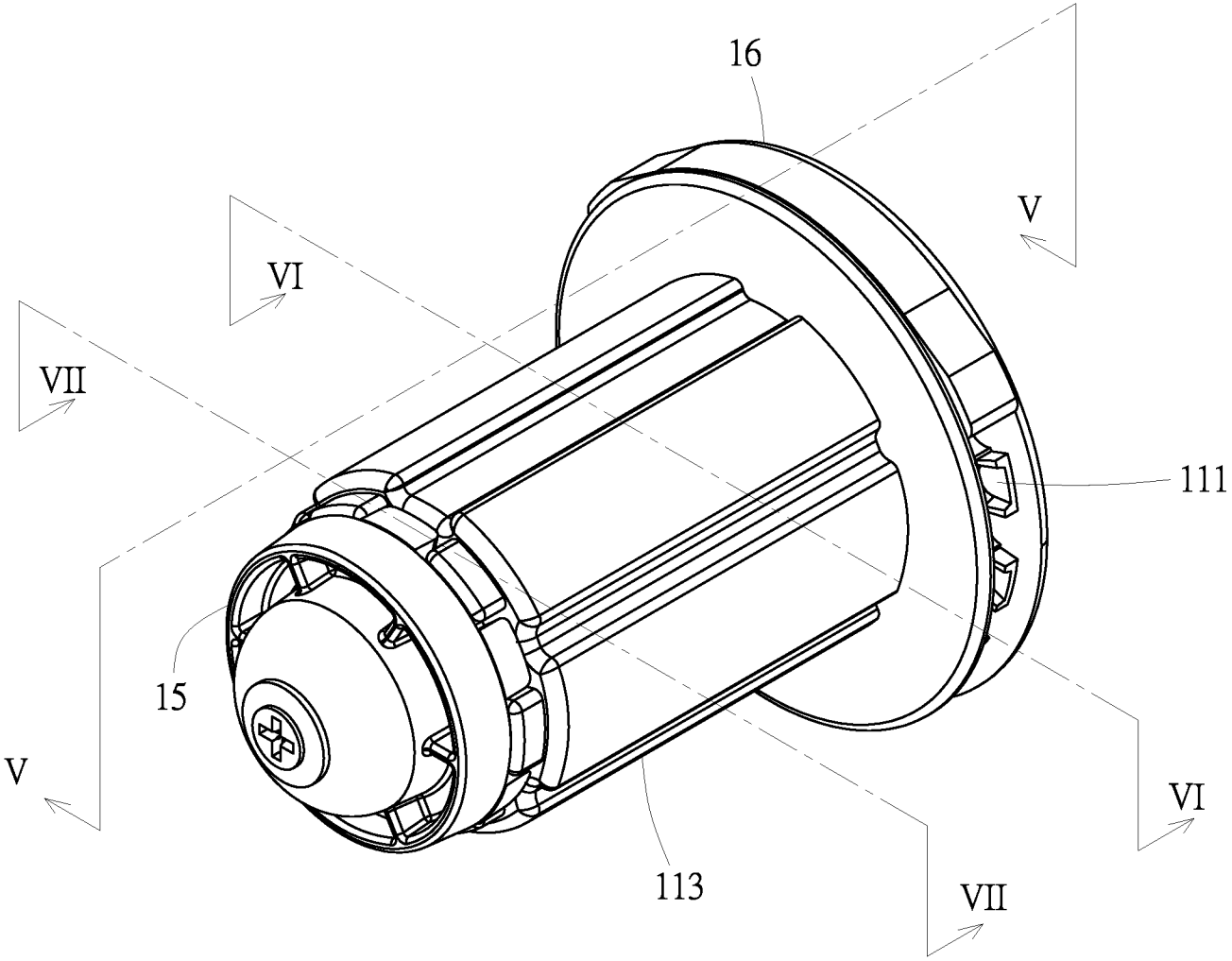
FIG. 4 is a perspective view of the control device of the present invention.

Referring to FIG. 3 and FIG. 4, the control device (1) mainly includes a reeling mechanism (11), a solenoid valve (12), and a damper. In the embodiment of the present invention, the damper is a first elastic member (13). The control device (1) further includes a push mechanism (14), a front cap (15), and a fixing seat (16).

Figure 5:
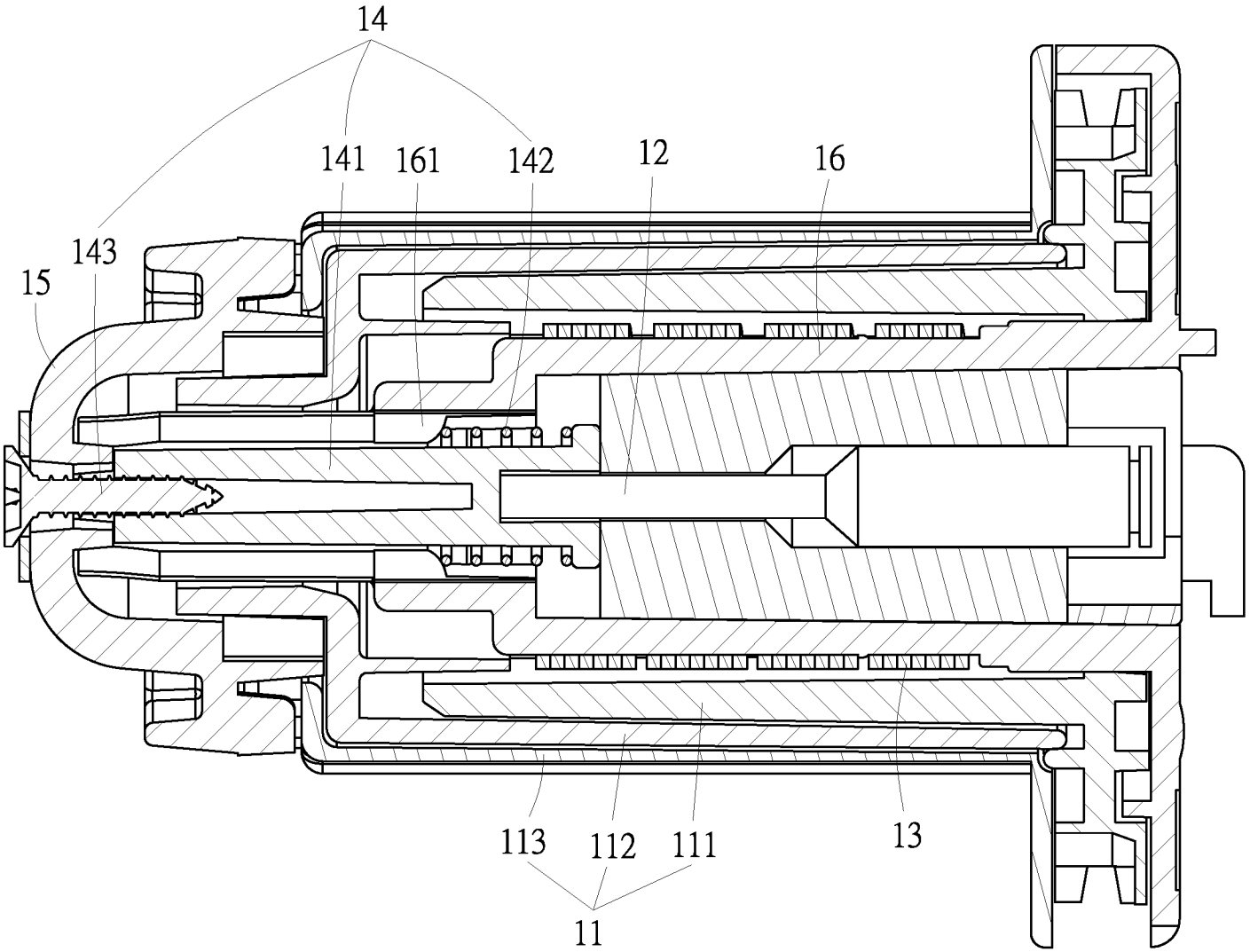
FIG. 5 is a cross-sectional view taken along line V-V of FIG. 4.
Figure 6:
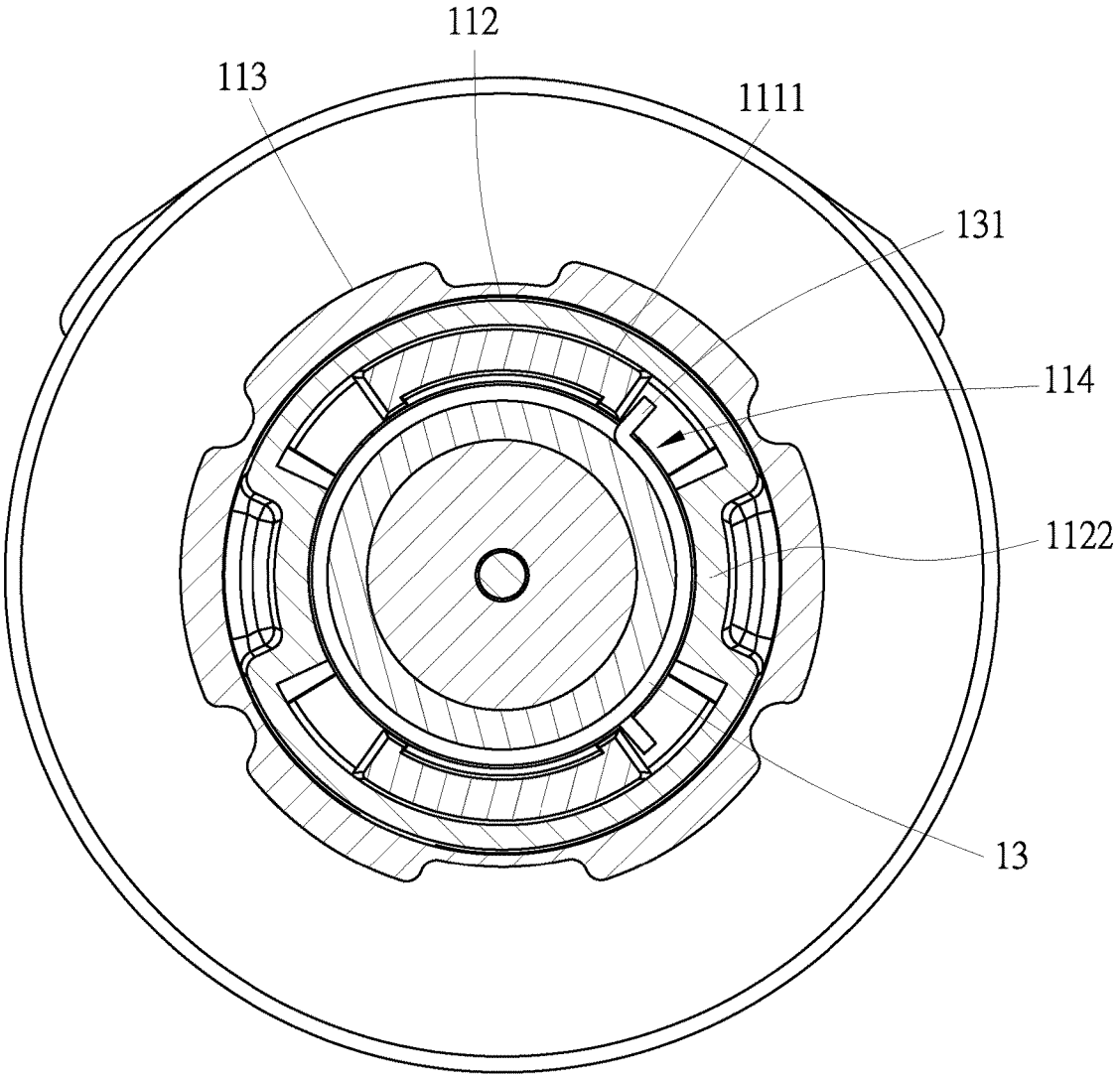
FIG. 6 is a cross-sectional view taken along line VI-VI of FIG. 4.

Referring to FIG. 5 and FIG. 6, the reeling mechanism (11) is disposed on the fixing base (16). The reeling mechanism (11) includes a reeling wheel (111), an inner cylinder (112), and an outer cylinder (113). The reeling wheel (111) has an action portion connected to the inner cylinder (112). In the embodiment of the invention, the action portion of the reeling wheel (111) is an extension piece (1111). The extension piece (1111) extends into the inner cylinder (112). The inner cylinder (112) has a blocking portion (1122) corresponding to the extension piece (1111). A part of the side wall of the inner cylinder (112) is recessed toward the center of the inner cylinder (112) to form the blocking portion (1122). An operation space (114) is defined between the blocking portion (1122) and the extension piece (1111). The first elastic member (13) is tightly sleeved on the fixing seat (16). The first elastic member (13) has a protruding portion (131). The protruding portion (131) of the first elastic member (13) extends into the operation space (114).

Figure 7:
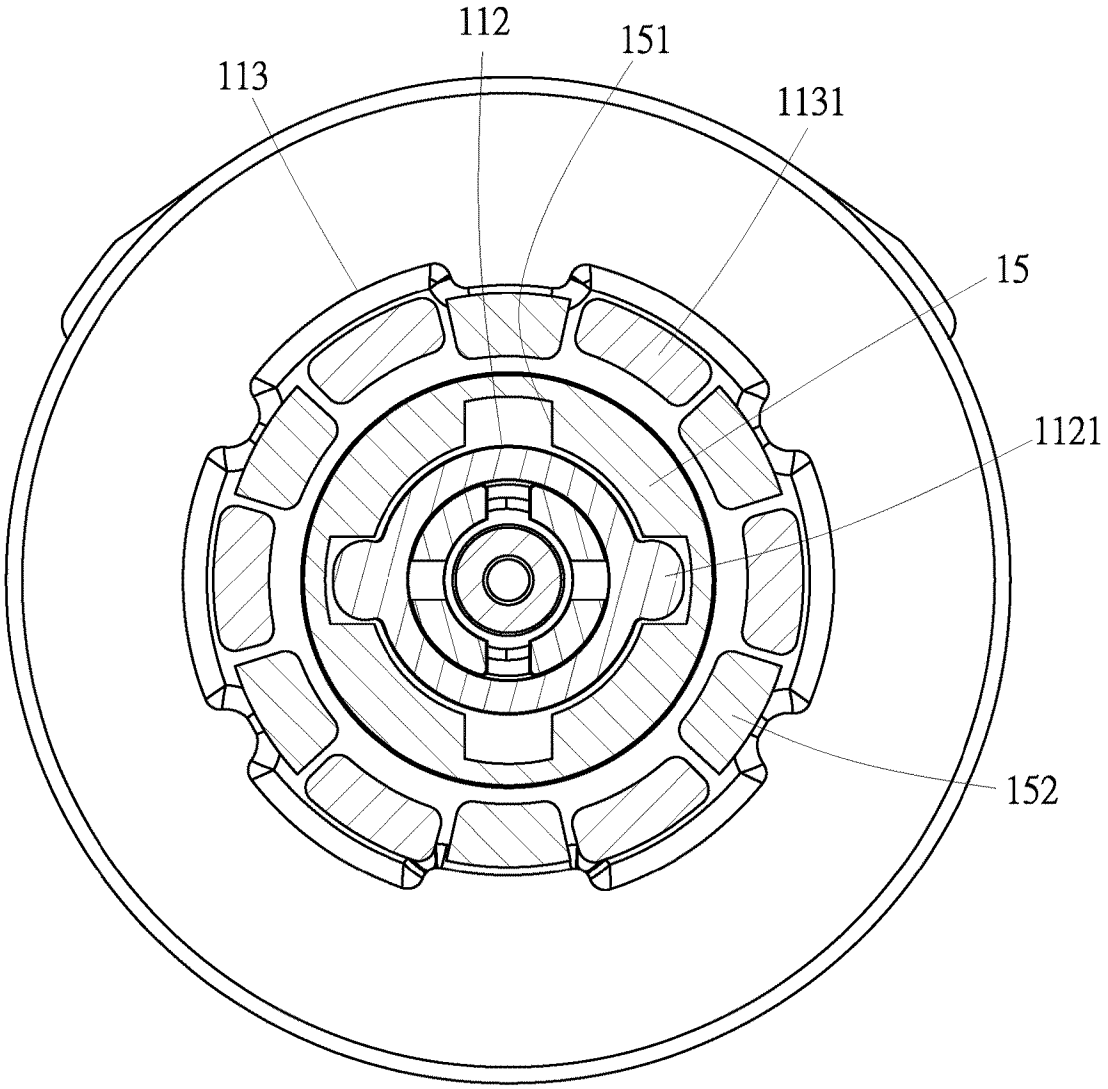
FIG. 7 is a cross-sectional view taken along line VII-VII of FIG. 4.

Referring to FIG. 5 and FIG. 7, the reeling mechanism (11) has an engaging portion. The engaging portion includes a first engaging portion disposed on the inner cylinder (112) and a second engaging portion disposed on the outer cylinder (113). The first engaging portion is a protrusion (1121). The second engaging portion is a plurality of spaced raised blocks (1131). The front cap (15) includes a cross-shaped engaging groove (151) and a plurality of spaced engaging blocks (152). The protrusion (1121) of the inner cylinder (112) is detachably engaged in the engaging groove (151) of the front cap (15). The plurality of raised blocks (1131) of the outer cylinder (113) are detachably engaged with the plurality of engaging blocks (152) of the front cap (15). Thereby, the inner cylinder (112) and the outer cylinder (113) are detachably engaged with the front cap (15). The solenoid valve (12) is disposed in the reeling mechanism (11). More specifically, the solenoid valve (12) is disposed in the fixing seat (16). Both the solenoid valve (12) and the fixing seat (16) are received in the inner cylinder (112) and the outer cylinder (113). The push mechanism (14) is movably disposed on the reeling mechanism (11) and connected to the solenoid valve (12). The push mechanism (14) includes a shaft (141), a second elastic member (142), and a screw (143). The second elastic member (142) is disposed on the shaft (141). The shaft (141) is connected to the solenoid valve (12). The shaft (141) of the push mechanism (14) is locked to the front cap (15) by the screw (143), so that the front cap (15) is coupled to the shaft (141) of the push mechanism (14). The fixing seat (16) has a retaining wall (161) corresponding to the second elastic member (142). The retaining wall (161) is formed by recessing the side wall of the fixing seat (16) toward the center of the fixing seat (16) to form an annular area.

Figure 8:
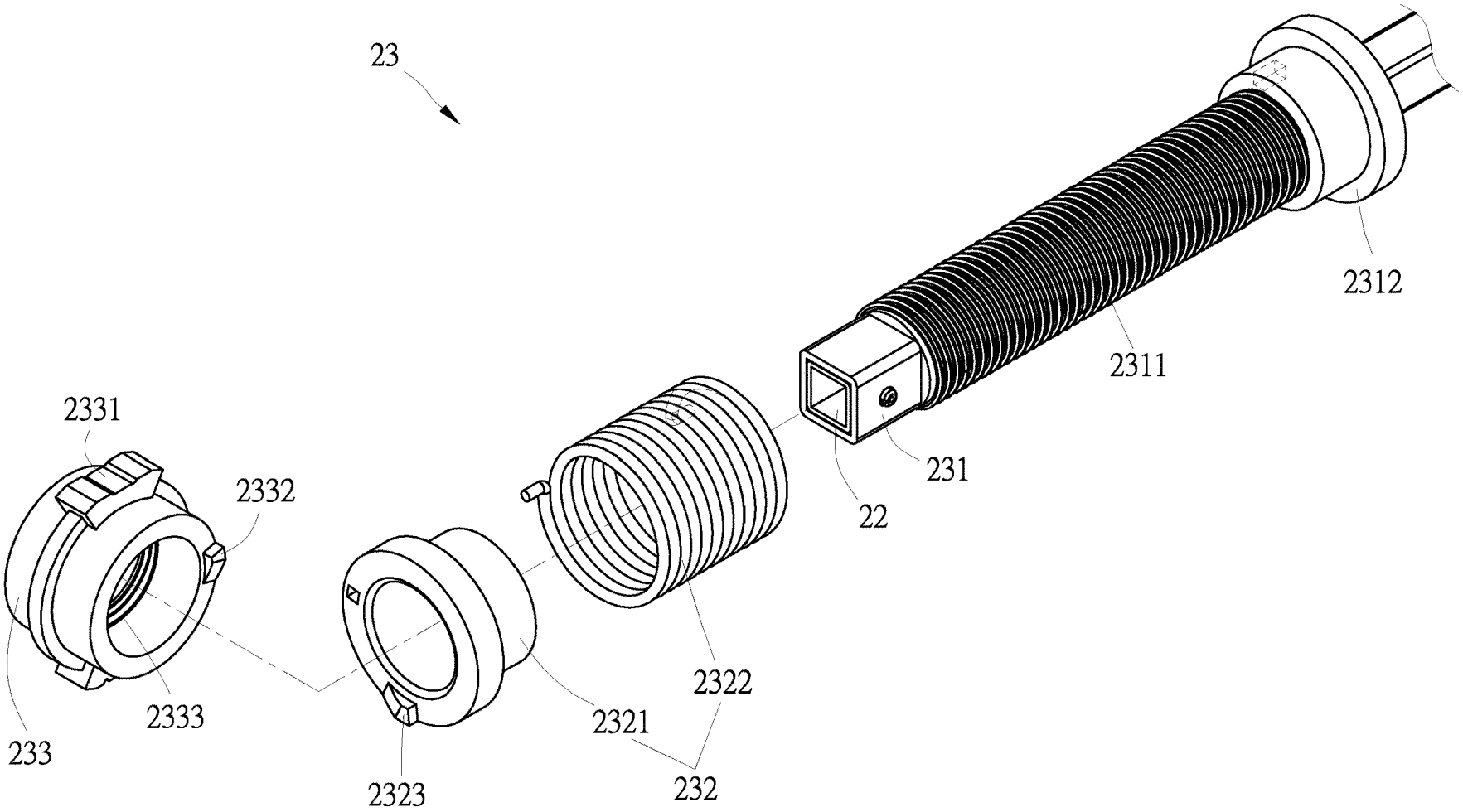
FIG. 8 is an exploded view of the limiting mechanism of the present invention.
Figure 9:
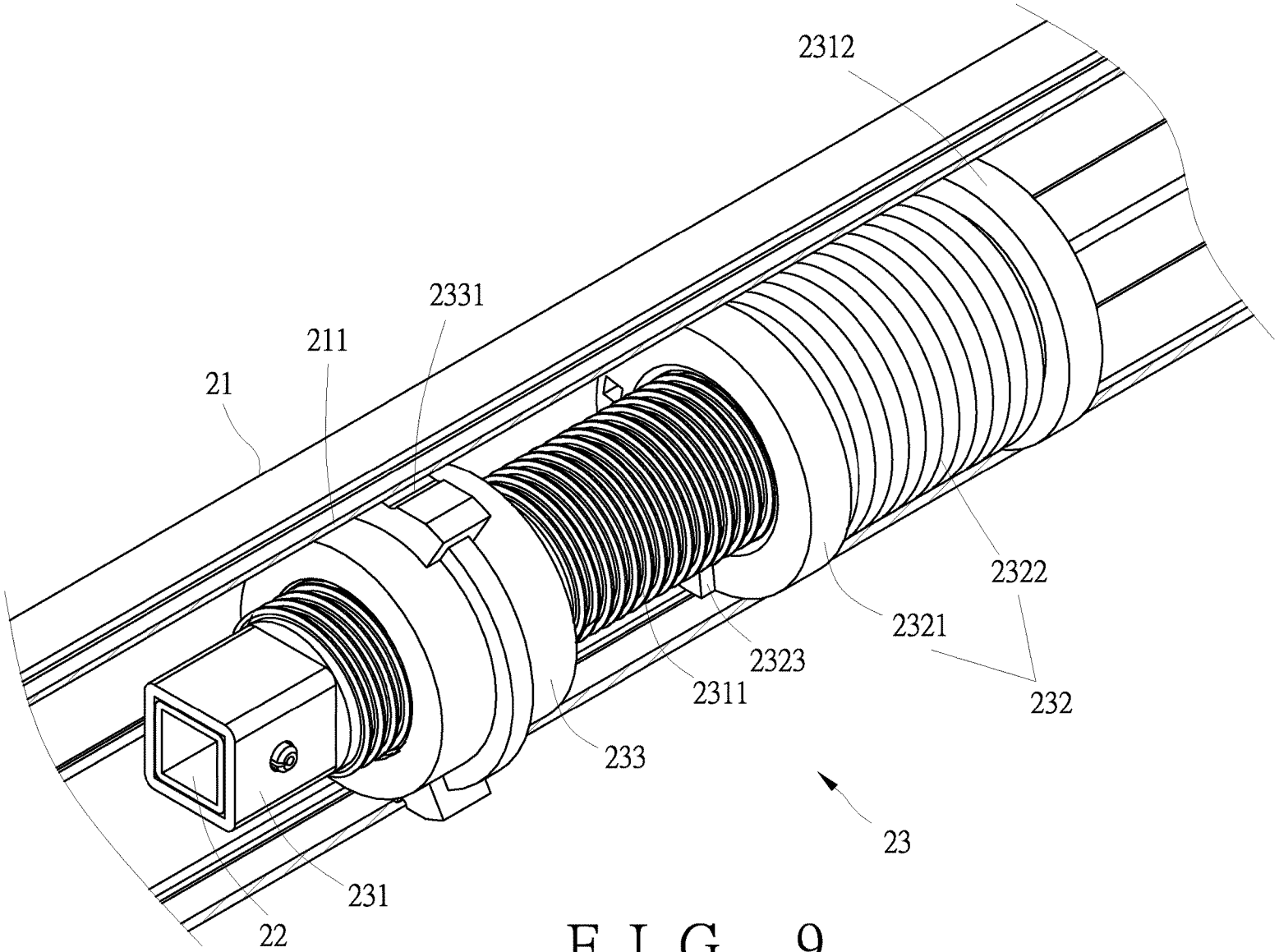
FIG. 9 is a perspective view of the limiting mechanism of the present invention.

Referring to FIG. 8 and FIG. 9, the outer tube (21) includes a limiting rib (211). The limiting mechanism (23) includes an inner tube (231), a slider, and a limiting seat (232). In the embodiment of the invention, the slider is a first slider (233). The inner tube (231) is sleeved on one end of the outer rod (22). The inner tube (231) has a square shape. The outer rod (22) also has a square shape. The inner tube (231) is locked to the outer rod (22) by a fixing member. The fixing member may be a pin, a bolt and the like, so that the inner tube (231) and the outer rod (22) are not relatively rotated or displaced. The first slider (233) is rotationally moved on the inner tube (231). The first slider (233) has a limiting portion (2331), a first coupling portion (2332), and a first threaded portion (2333). The limiting rib (211) of the outer tube (21) is located in the limiting portion (2331). The inner tube (231) has a second threaded portion (2311) and a retaining portion (2312). The first threaded portion (2333) of the first slider (233) is meshed with the second threaded portion (2311) of the inner tube (231). The limiting seat (232) includes a second slider (2321), a buffer elastic member (2322), and a second coupling portion (2323). The buffer elastic member (2322) is disposed between the inner tube (231) and the second slider (2321). One end of the buffer elastic member (2322) is fixedly connected to the second slider (2321), and another end of the buffer elastic member (2322) is fixedly connected to the retaining portion (2312) of the inner tube (231). The second coupling portion (2323) is disposed on the second slider (2321). The first coupling portion (2332) and the second coupling portion (2323) are raised blocks.

Figure 10:
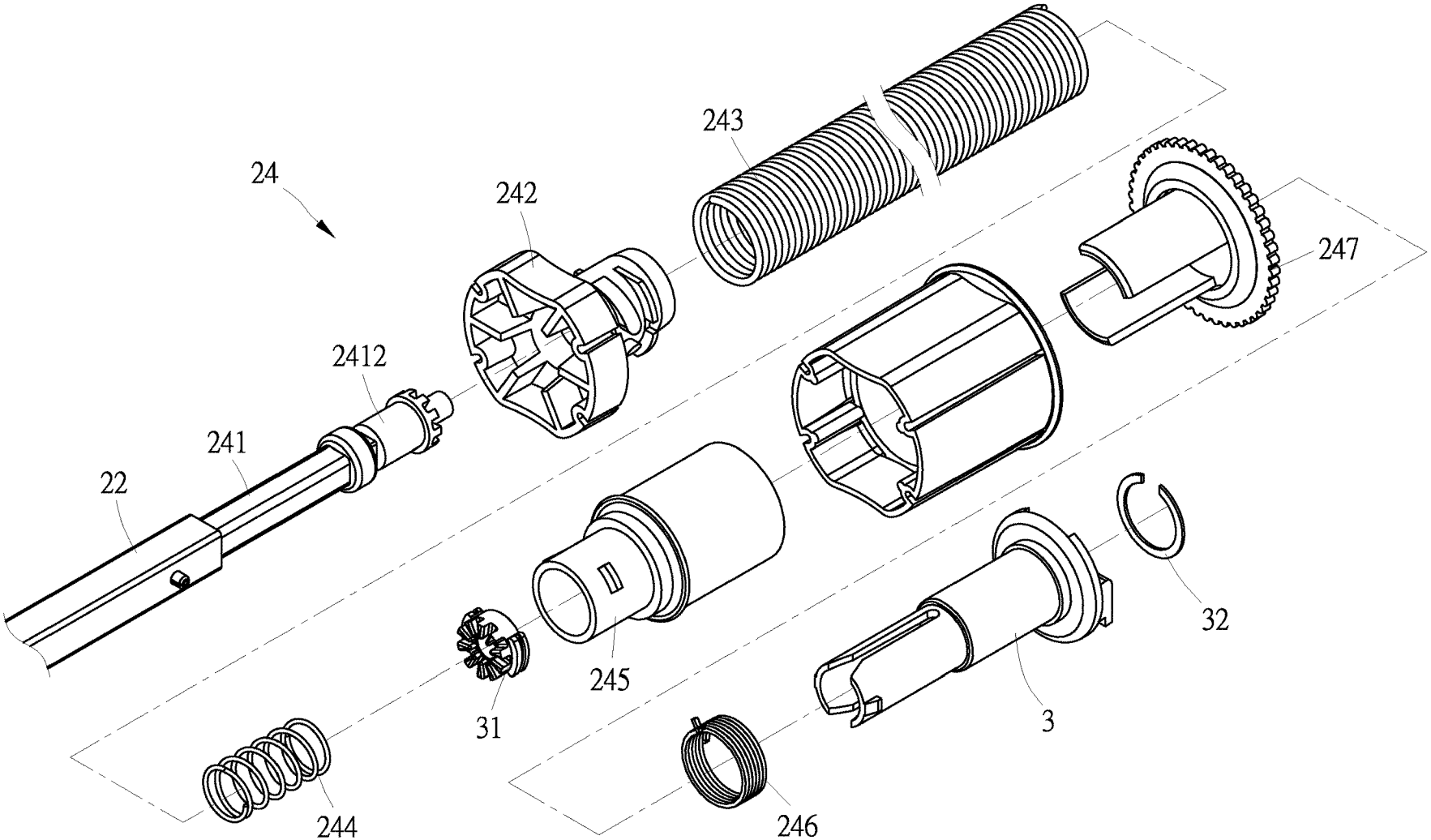
FIG. 10 is an exploded view of the adjustment mechanism of the present invention.
Figure 11:
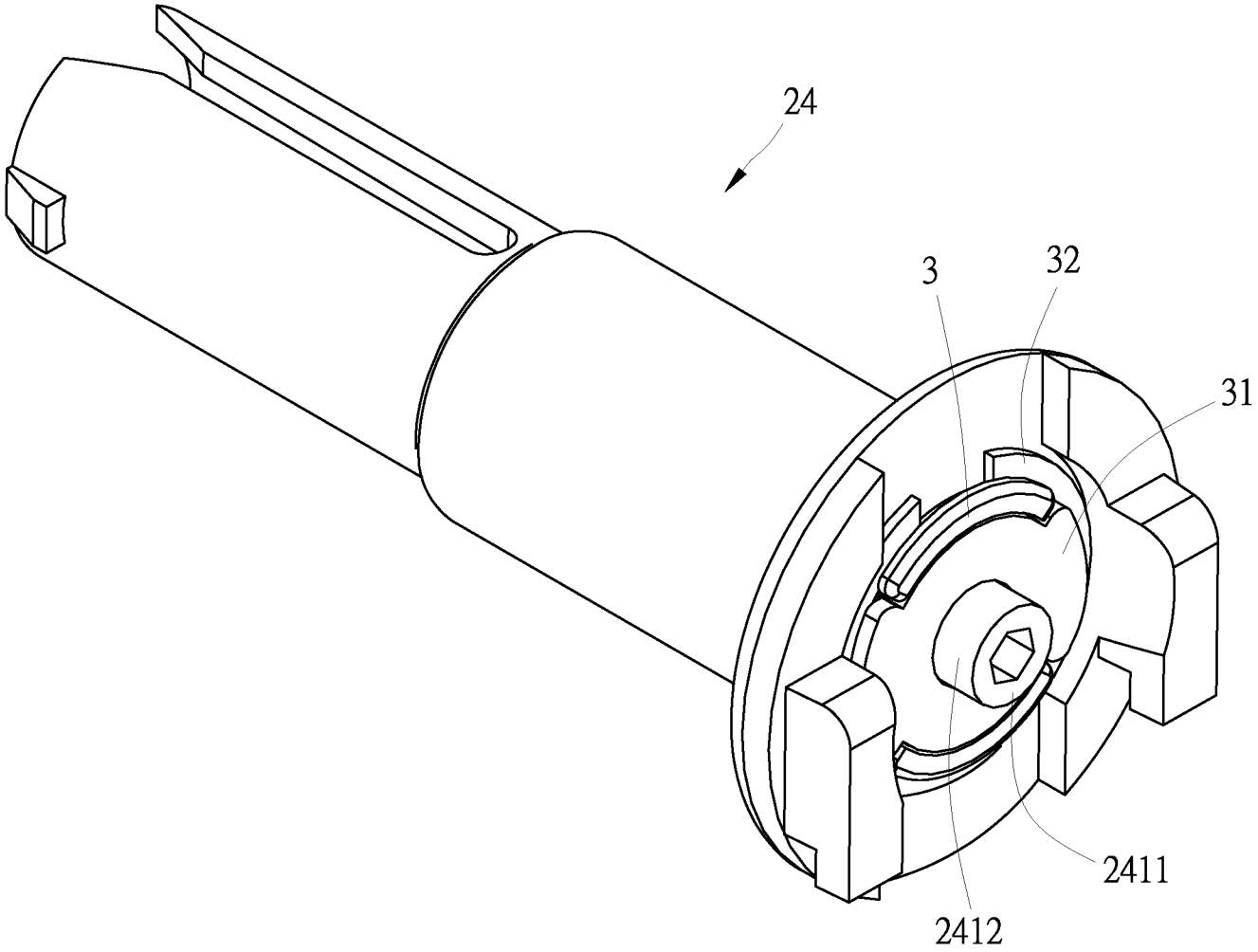
FIG. 11 is a perspective view of the adjustment mechanism of the present invention.

Referring to FIG. 10 and FIG. 11, the adjustment mechanism (24) includes an adjustment member, an inner rod (241), a first sleeve (242), an auxiliary elastic member (243), a return elastic member (244), a second sleeve (245), and a brake elastic member (246). The adjustment member is a gear (247). The inner rod (241) is locked to the outer rod (22), and has an operation portion (2411) disposed at one end of the inner rod (241) away from the outer rod (22). The inner rod (241) includes a first coupling member (2412). The first coupling member (2412) is correspondingly engaged with a second coupling member (31). The second coupling member (31) is coupled to the tail seat (3) by a C-shaped retaining ring (32). In the embodiment of the invention, the operation portion (2411) is disposed on the first coupling member (2412). The second sleeve (245) is disposed on the tail seat (3). The first sleeve (242) is disposed in the outer tube (21) and is engaged with the outer tube (21). As to the outer tube (21), please refer to FIG. 9. The auxiliary elastic member (243) is connected to the first sleeve (242) and the second sleeve (245). The return elastic member (244) is sleeved on the inner rod (241). The brake elastic member (246) is tightly sleeved on the tail seat (3).

Figure 12:
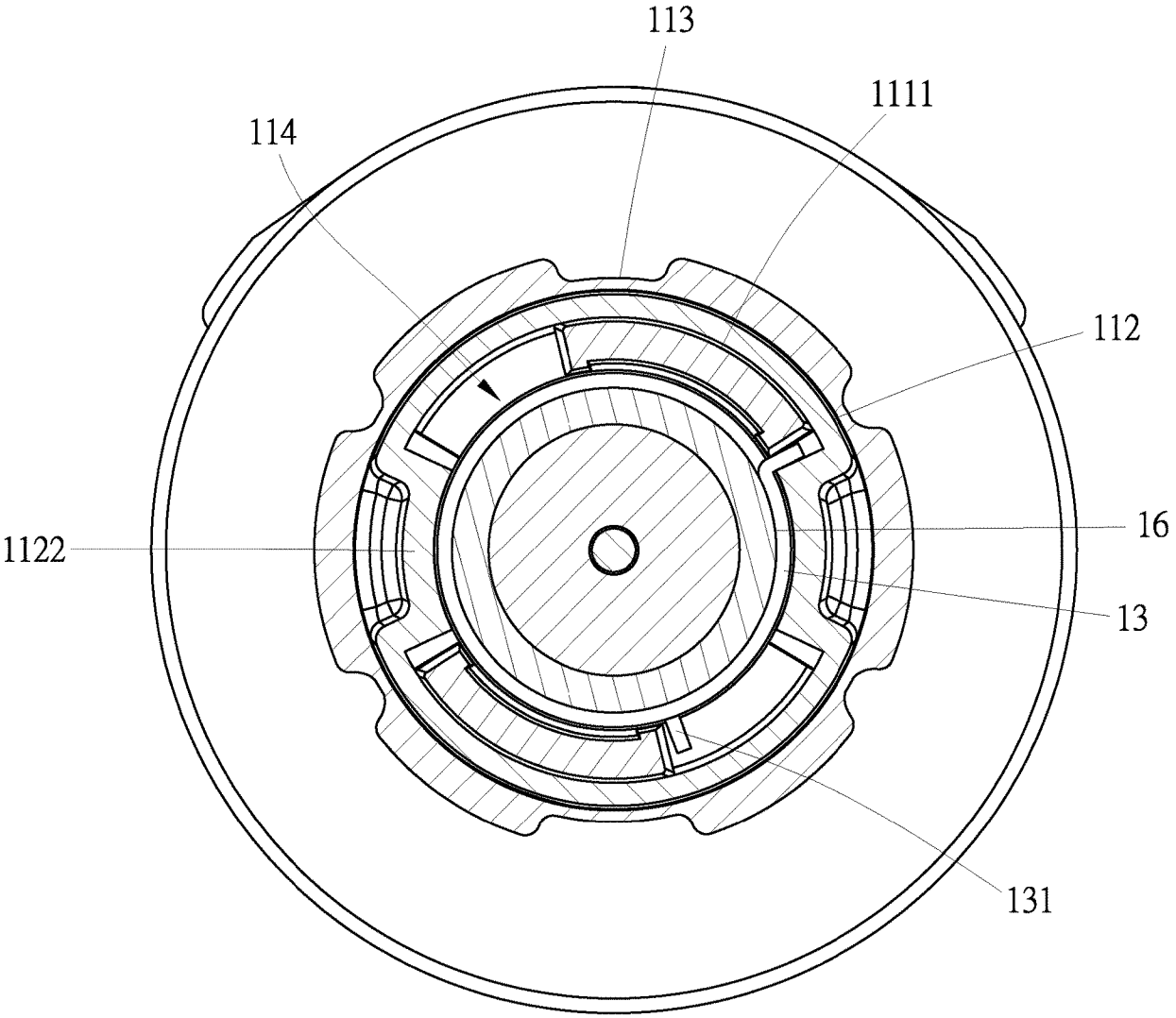
FIG. 12 is a cross-sectional view of the roller blind, illustrating that after the reeling wheel is rotated clockwise, the extension piece drives the inner cylinder to rotate clockwise.
Figure 13:
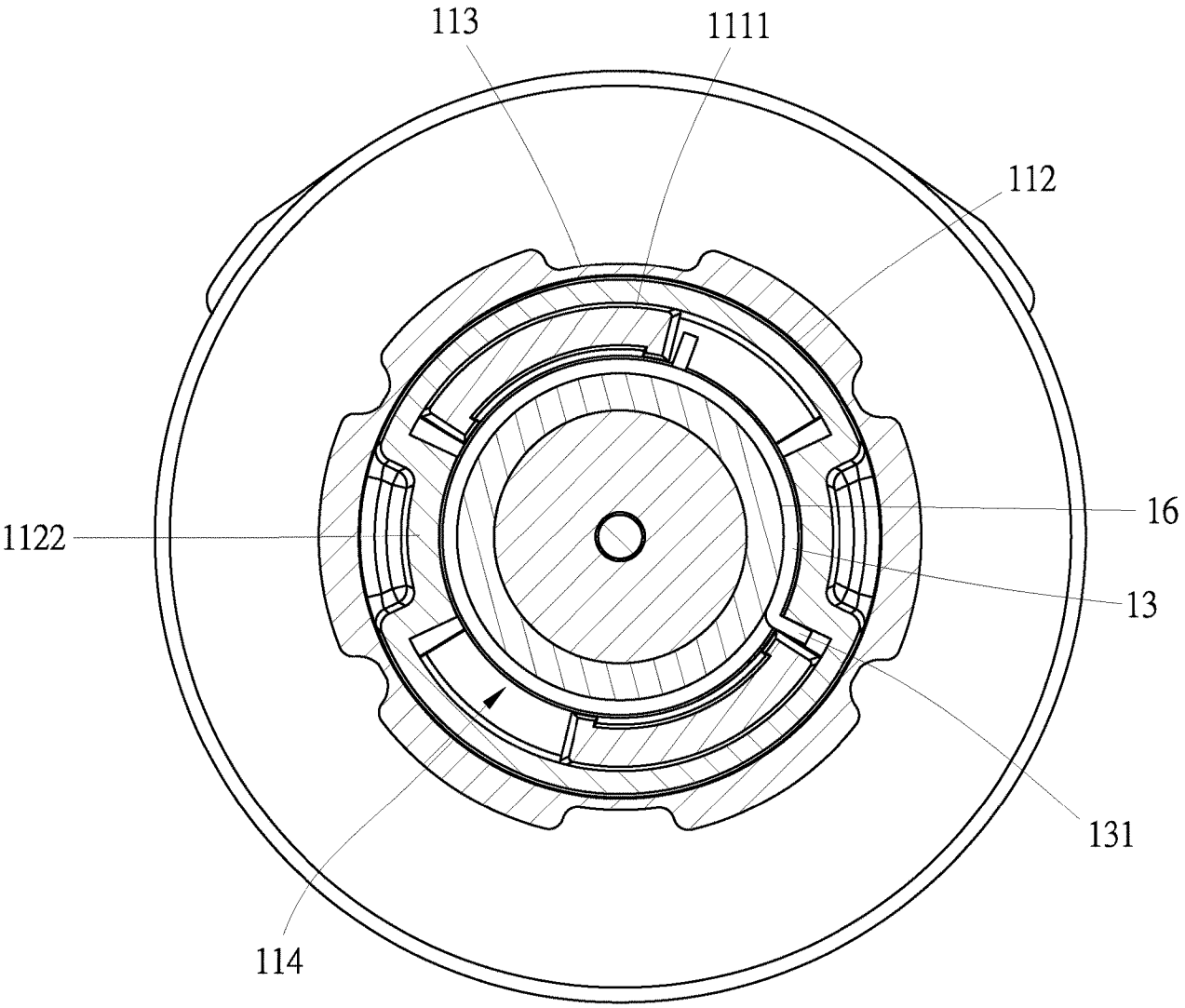
FIG. 13 is a cross-sectional view of the roller blind, illustrating that after the reeling wheel is rotated counterclockwise, the extension piece drives the inner cylinder to rotate counterclockwise.

Please refer to FIG. 12 and FIG. 13 in conjunction with FIG. 3. When the reeling wheel (111) is rotated, the extension piece (1111) of the reeling wheel (111) will be pushed against the protruding portion (131) of the first elastic member (13) to release the first elastic member (13) from the fixing seat (16). When the reeling wheel (111) is used to lower or roll up the curtain fabric (A) (as to the curtain fabric (A), please refer to FIG. 2), the extension piece (1111) pushes against the protruding portion (131) of the first elastic member (13) in clockwise or counterclockwise directions. For example, when the reeling wheel (111) is rotated clockwise to lower the curtain fabric (A), the extension piece (1111) will be clockwise pushed against the protruding portion (131) of the first elastic member (13). The protruding portion (131) of the first elastic member (13) is moved clockwise in the operation space (114) to release the first elastic member (13) from the fixing seat (16) so as to rotate relative to the fixing seat (16). When the protruding portion (131) of the first elastic member (13) is rotated to lean against the blocking portion (1122) of the inner cylinder (112), if the reeling wheel (111) continues to rotate clockwise, the extension piece (1111) is continuously pushed against the protruding portion (131), so that the inner cylinder (112) is driven to rotate by the blocking portion (1122) and the protruding portion (131) or by the contact of the extension piece (1111). Because the protrusion (1121) of the inner cylinder (112) and the raised blocks (1131) of the outer cylinder (113) are detachably engaged in the engaging groove (151) and between the engaging blocks (152) of the front cap (15), respectively, after the reeling wheel (111) pulls the curtain fabric (A) and the inner cylinder (112) is driven by the reeling wheel (111), the outer cylinder (113) and the front cap (15) are linked by the inner cylinder (112) to lower the curtain fabric (A). Similarly, when the curtain fabric (A) is to be rolled up, the reeling wheel (111) is rotated counterclockwise, and the inner cylinder (112) is rotated counterclockwise by the extension piece (1111), so as to roll up the curtain fabric (A).

When the reeling wheel (111) stops pulling the curtain fabric (A), for example, rotating the reeling wheel (111) counterclockwise to roll up the curtain fabric (A), after the curtain fabric (A) is rolled up and when the reeling wheel (111) is released, the outer cylinder (113) may rotate the front cap (15) and the inner cylinder (112) clockwise due to the gravity of the curtain fabric (A). However, after the inner cylinder (112) rotates clockwise, the blocking portion (1122) of the inner cylinder (112) pushes against the protruding portion (131) of the first elastic member (13), so that the first elastic member (13) is tightly sleeved on the fixing seat (16) again. The first elastic member (13) does not rotate relative to the fixing seat (16), so that the inner cylinder (112), the front cap (15) and the outer cylinder (113) also cannot rotate. Therefore, the curtain fabric (A) is positioned without falling down. This is not shown in the drawings, and is only described herein.

Figure 14:
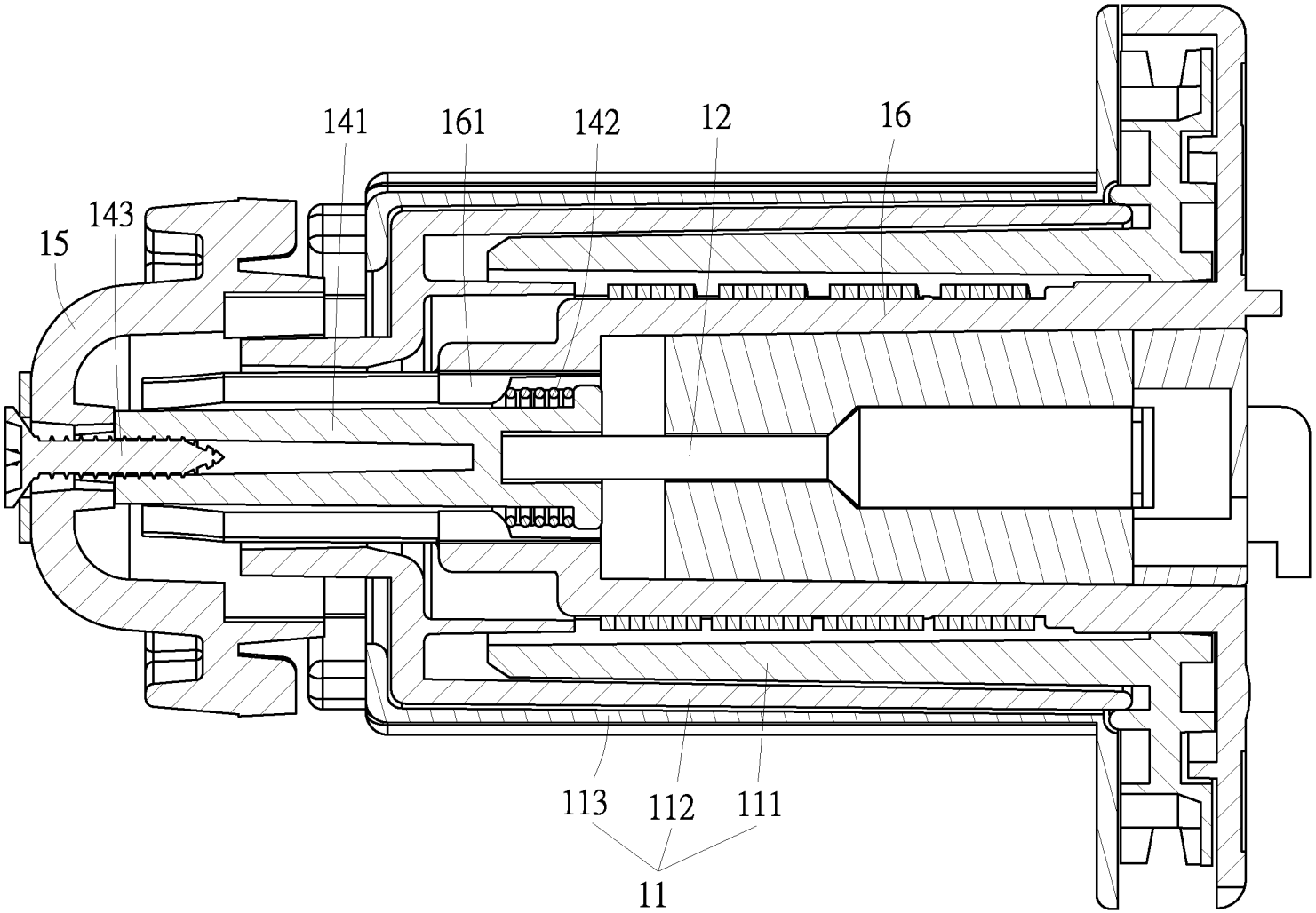
FIG. 14 is a cross-sectional view of the roller blind, illustrating that the solenoid valve is energized to disengage the front cap from the reeling mechanism.

Referring to FIG. 14 and FIG. 2, after the solenoid valve (12) is energized, the solenoid valve (12) controls the shaft (141) to extend out and push the front cap (15), so that the front cap (15) is separated from the inner cylinder (112) and the outer cylinder (113). The reeling mechanism (11) is free from the resistance of the first elastic member (13), and the curtain fabric (A) can be quickly lowered by gravity, and the second elastic member (142) is pressed against the retaining wall (161) to be compressed and store an elastic potential energy. After the solenoid valve (12) is powered off, since the front cap (15) and the shaft (141) are locked and connected by the screw (143), the second elastic member (142) releases the elastic potential energy to return the shaft (141), and the front cap (15) is engaged with the inner cylinder (112) and the outer cylinder (113) again.

Figure 15:
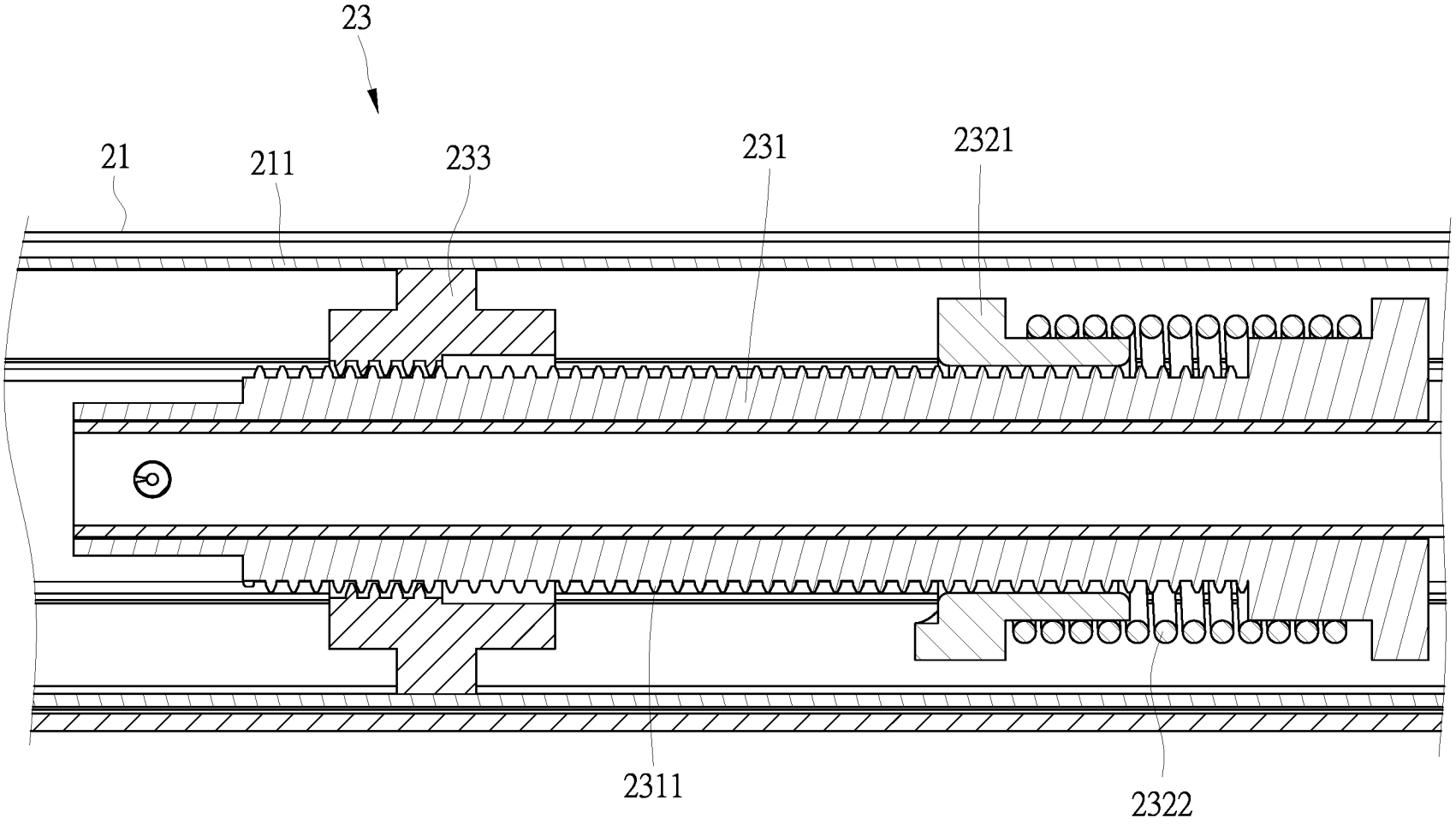
FIG. 15 is a cross-sectional view of the roller blind, illustrating the state in which the first slider is not moved.
Figure 16:
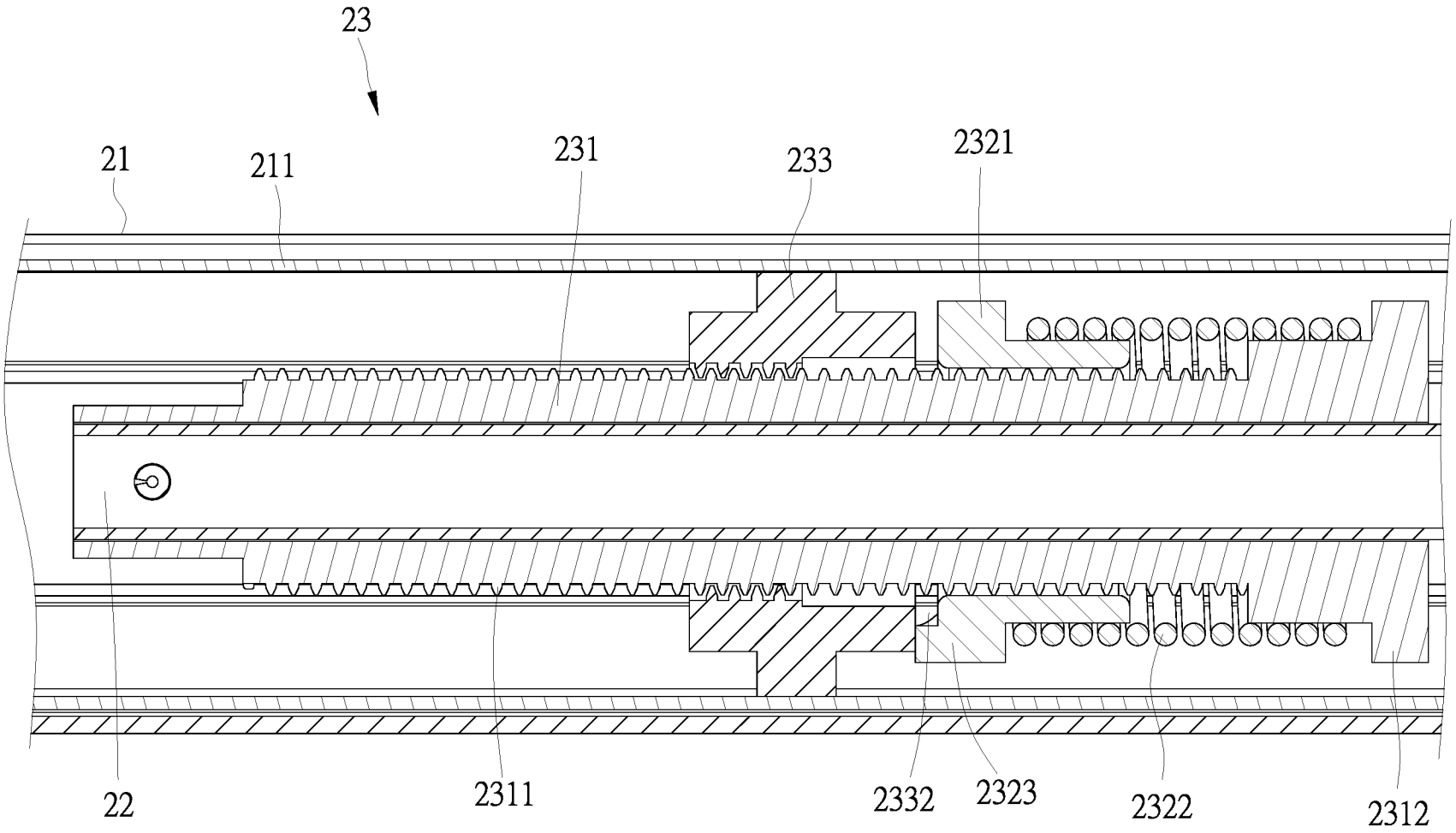
FIG. 16 is a cross-sectional view of the roller blind, showing that the first slider is pushed against the second slider.

Please refer to FIG. 15 and FIG. 16 in conjunction with FIG. 2. When the outer tube (21) is rotated to lower the curtain fabric (A), the outer tube (21) drives the first slider (233) to rotate and move on the inner tube (231) along the limiting rib (211) in cooperation with the second threaded portion (2311) of the inner tube (231) towards the second slider (2321). When the first slider (233) is pushed against the second slider (2321), the first coupling portion (2332) is coupled to the second coupling portion (2323). The first slider (233) is blocked by the second slider (2321) and does not continue to rotate on the inner tube (231). Since the first slider (233) is no longer rotated, the outer tube (21) does not rotate. Thus, the curtain fabric (A) is restrained from falling.

Figure 17:
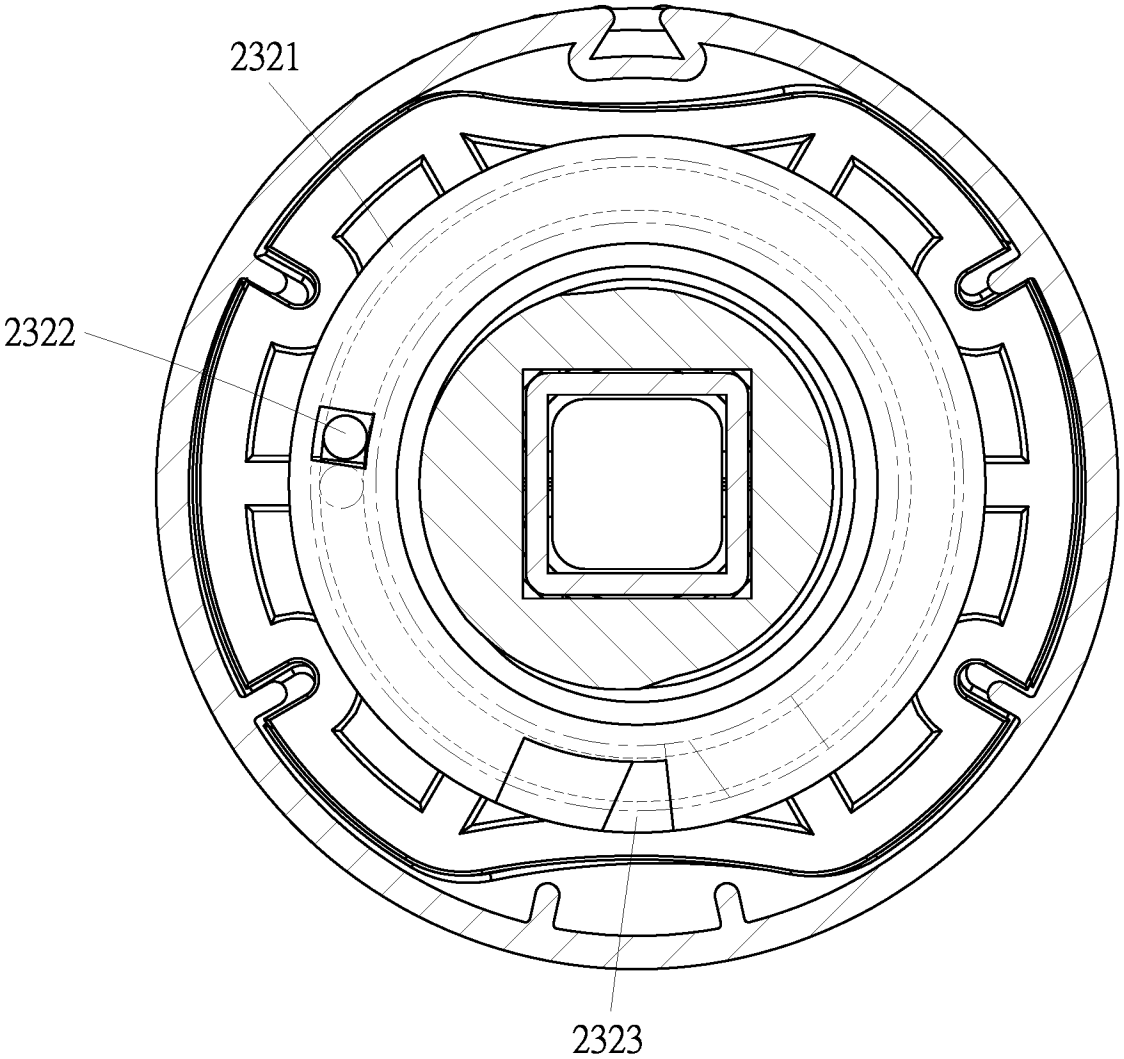
FIG. 17 is a cross-sectional view of the roller blind, illustrating the state of the buffer elastic member when the first slider is not pushed against the second slider.
Figure 18:
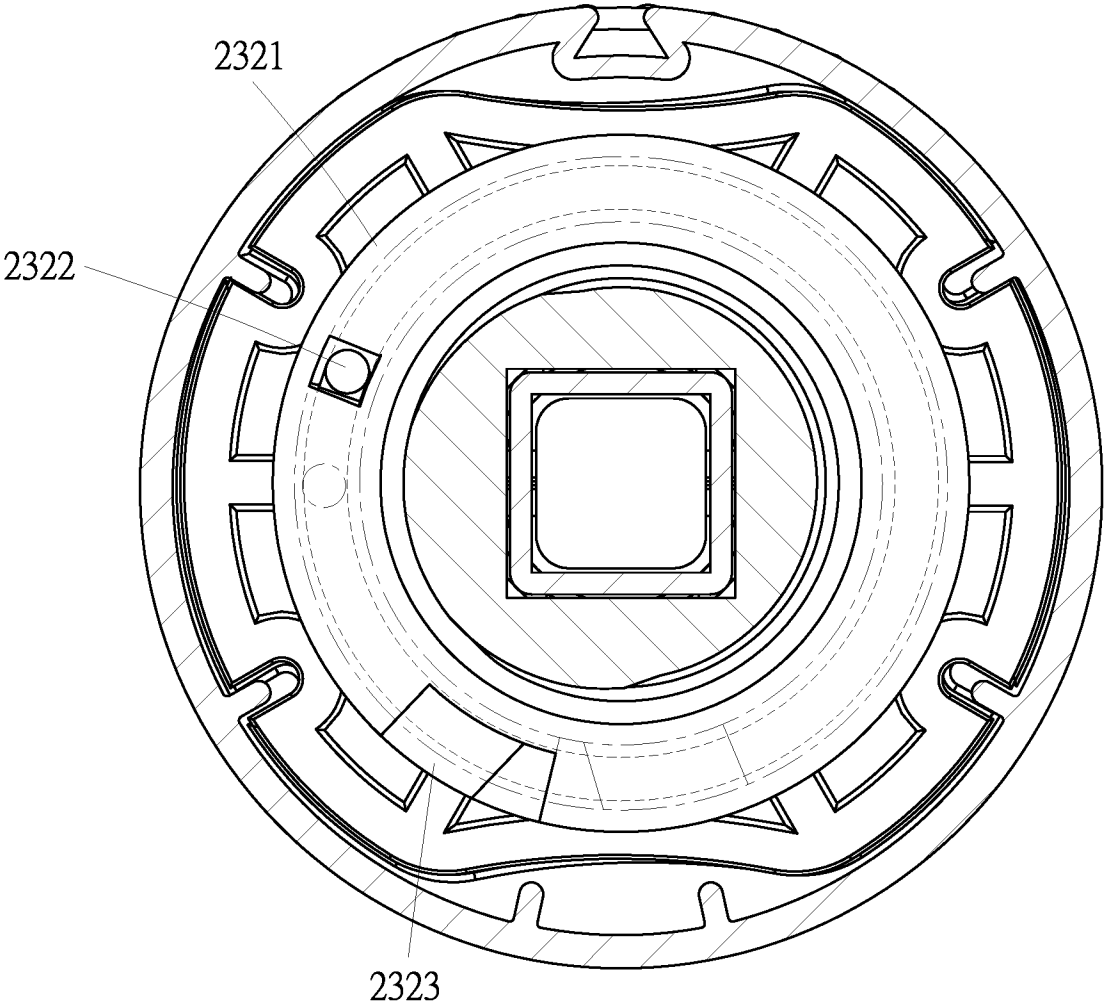
FIG. 18 is a cross-sectional view of the roller blind, illustrating the state of the buffer elastic member after the first slider is pushed against the second slider.

Referring to FIG. 16 to FIG. 18, after the first coupling portion (2332) of the first slider (233) is coupled to the second coupling portion (2323) of the second slider (2321), the first slider (233) still drives the second slider (2321) to rotate due to inertia. At this time, one end of the buffer elastic member (2322) is twisted by the second slider (2321), but the other end is still fixed on the retaining portion (2312) of the inner tube (231). The inner tube (231) is restrained by the outer rod (22) without rotating. The buffer elastic member (2322) thus stores a buffer elastic potential energy, so that the second slider (2321) stops rotating. The first slider (233) is restrained by the second slider (2321) to stop the outer tube (21) from rotating. In this way, the buffer elastic member (2322) can slow down the impact force when the curtain fabric (A) is restrained (as to the curtain fabric (A), please refer to FIG. 2), which indeed maintains the restraining state and can avoid that although the first slider (233) is blocked by the second slider (2321) and cannot continue to rotate on the inner tube (231), the second slider (2321) is still rotated in the original position and cannot be surely restrained. Besides, the buffer elastic member (2322) can avoid excessive impact force to damage the limiting mechanism (23) or the whole roller blind. When the curtain fabric (A) is rolled up, the outer tube (21) drives the first slider (233) to rotate reversely along the limiting rib (211) in cooperation with the second thread portion (2311) of the inner tube (231) to move away from the second slider (2321). At this time, the buffer elastic member (2322) releases the buffer elastic potential energy to return the second slider (2321). This is not shown in the drawings.

Figure 19:
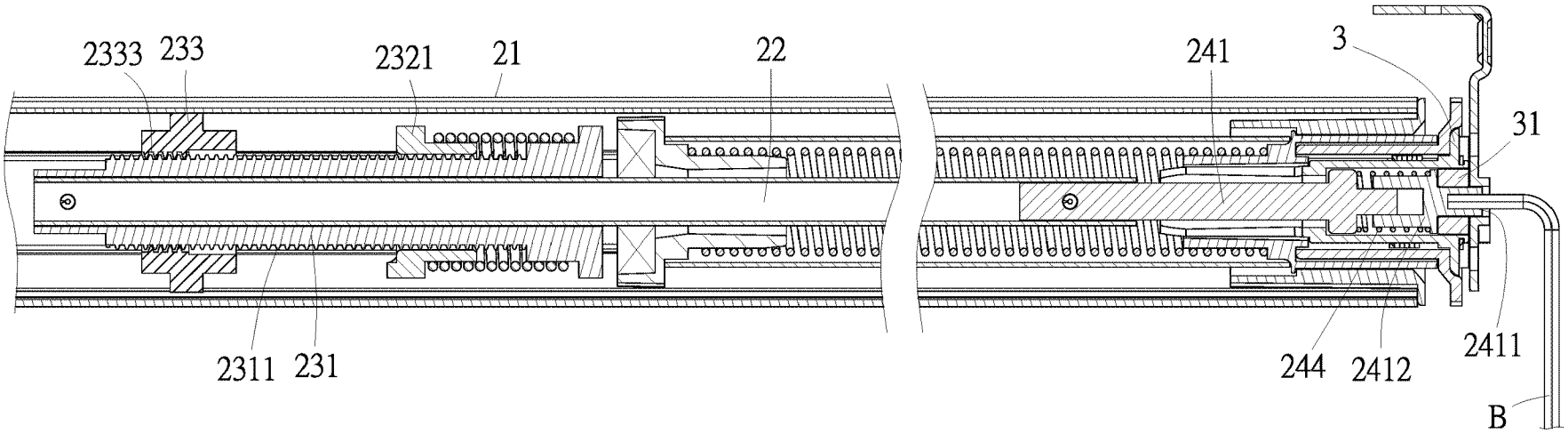
FIG. 19 is a cross-sectional view of the roller blind, illustrating the state when the operation portion of the inner rod is not operated.
Figure 20:
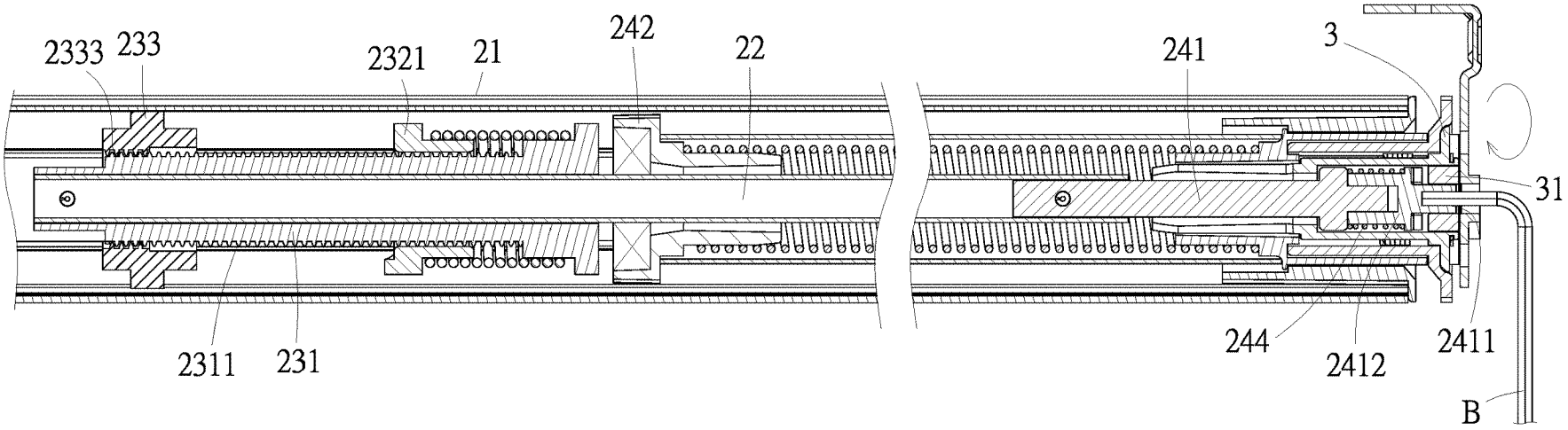
FIG. 20 is a cross-sectional view of the roller blind, illustrating the distance between the first slider and the second slider after the operation portion of the inner rod is operated.

Please refer to FIG. 19 and FIG. 20 in conjunction with FIG. 2. The operation portion (2411) of the inner rod (241) is operated by a tool (B) such as a hex wrench to rotate the inner rod (241). First, an external force is applied to the inner rod (241) by using the tool (B), and the inner rod (241) is pressed towards the outer rod (22), so that the first coupling member (2412) of the inner rod (241) is separated from the second coupling member (31) of the tail seat (3). At the same time, the return elastic member (244) sleeved on the inner rod (241) is compressed by the inner rod (241) to store a return elastic potential energy. The inner rod (241) can drive the outer rod (22) to rotate relative to the outer tube (21), so that the first slider (233) is rotated and moved through the cooperation between the first threaded portion (2333) and the second threaded portion (2311) of the inner tube (231), so as to adjust a distance between the first slider (233) and the second slider (2321). The distance corresponds to the length of the curtain fabric (A) to be lowered. For example, the distance is the lead length of the first threaded portion (2333) rotated ten times relative to the second threaded portion (2311). After the curtain fabric (A) is lowered, the outer tube (21) is rotated ten times, and the first slider (233) is pushed to the second slider (2321) to stop the curtain fabric (A) from falling. At this time, the length of the curtain fabric (A) to be lowered will be ten times the circumference of the outer tube (21). In addition to restraining the curtain fabric (A) with the limiting mechanism (23) to prevent the curtain fabric (A) from lowering excessively, a user can operate the operation portion (241) of the inner rod (241) to adjust the distance between the first slider (233) and the second slider (2321), so as to restrain the curtain fabric (A) at a desired height. After the distance is adjusted, the user stops operating the operation portion (2411), and the external force is no longer applied to the inner rod (241). The return elastic member (244) releases the return elastic potential energy to return the inner rod (241), so that the first coupling member (2412) of the inner rod (241) is coupled to the second coupling member (31) of the tail seat (3) again. The inner rod (241) does not rotate anymore, so that the distance after adjusted can be kept.

Figure 21:
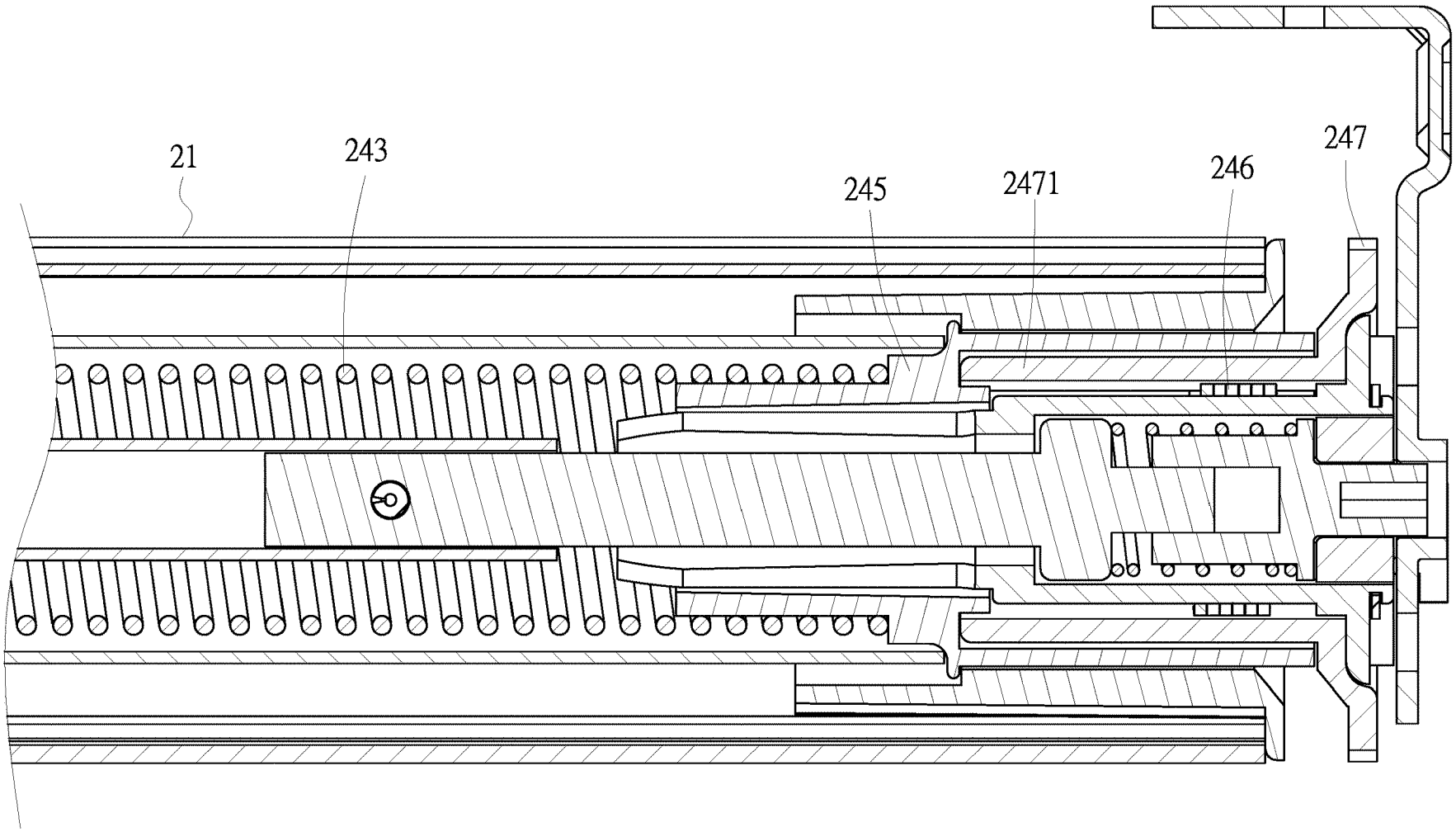
FIG. 21 is a cross-sectional view of the roller blind, illustrating the state of the auxiliary elastic member when the gear is not rotated.
Figure 22:
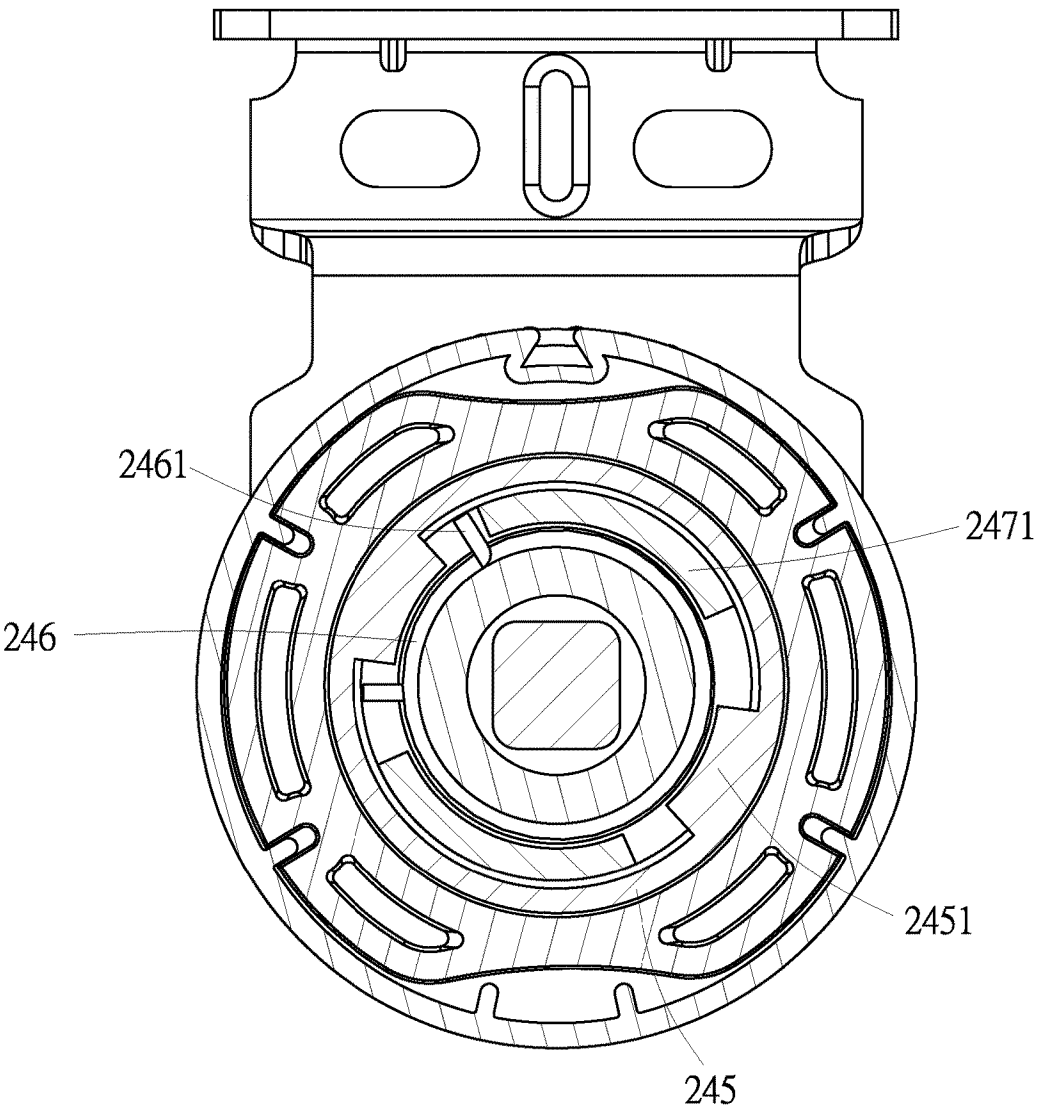
FIG. 22 is a cross-sectional view of the roller blind, illustrating the state of the brake elastic member when the gear is not rotated.

Please refer to FIG. 21 and FIG. 22 in conjunction with FIG. 2. In general, when the curtain fabric (A) is to be rolled up or lowered, the brake elastic member (246) will be tightly fitted on the tail seat (3). The brake elastic member (246) has a brake protruding portion (2461) that is located between a gear extension portion (2471) of the gear (247) and a second sleeve blocking portion (2451) of the second sleeve (245).

Figure 23:
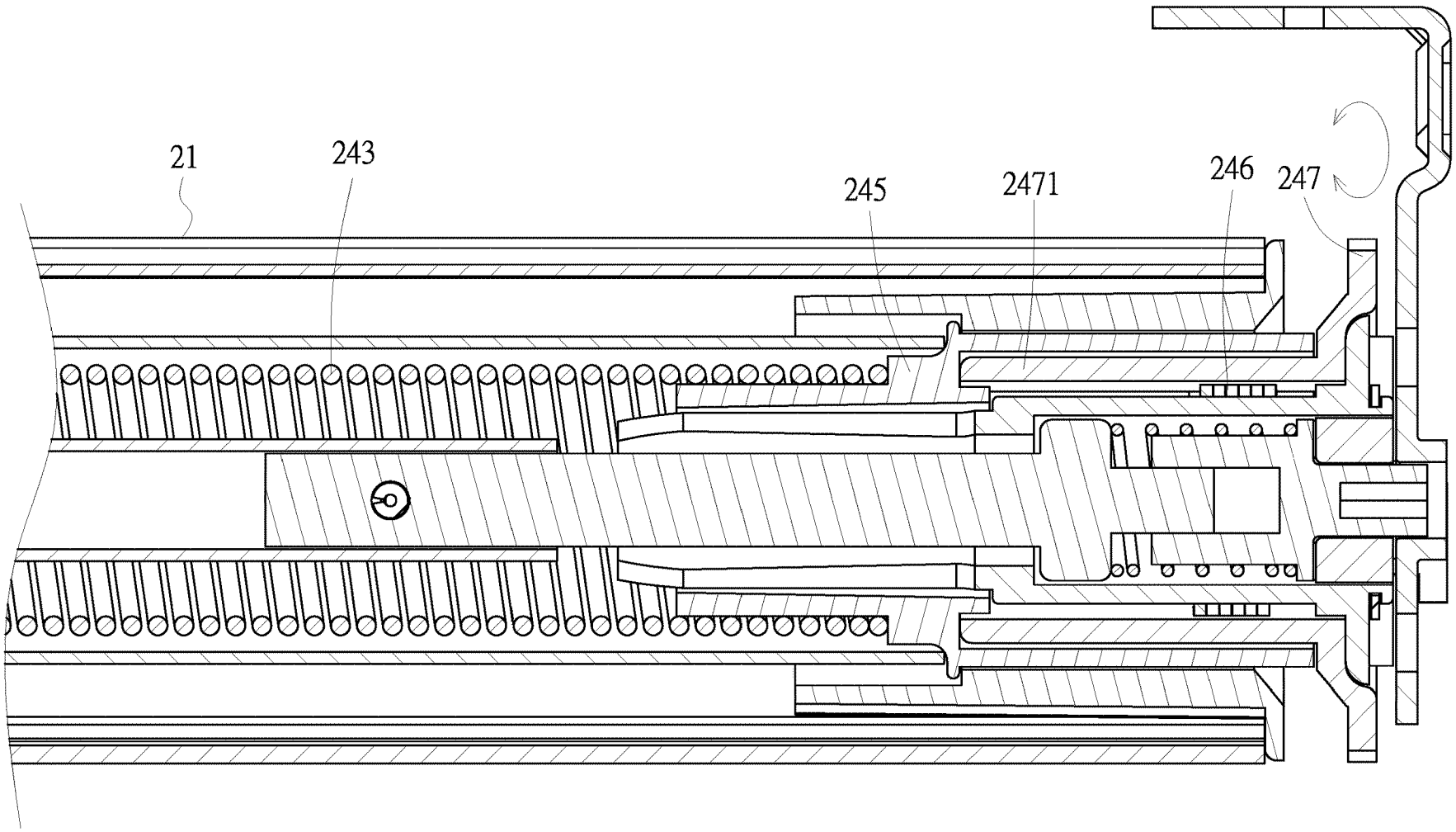
FIG. 23 is a cross-sectional view of the roller blind, illustrating the state of the auxiliary elastic member after the gear is rotated.
Figure 24:
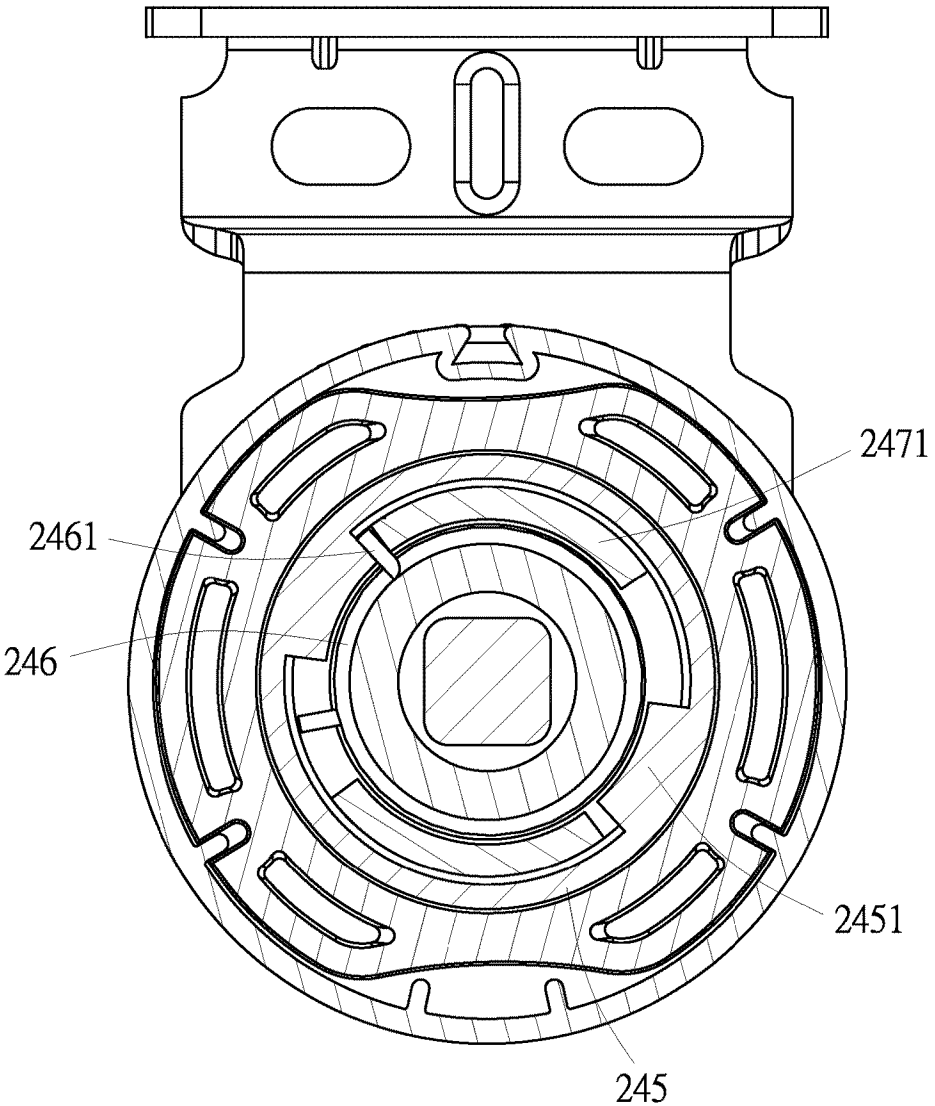
FIG. 24 is a cross-sectional view of the roller blind, illustrating the state of the brake elastic member after the gear is rotated.

Please refer to FIG. 20, FIG. 23 and FIG. 24 in conjunction with FIG. 2. When the curtain fabric (A) is lowered, the outer tube (21) drives the first sleeve (242) to rotate and further to drive the auxiliary elastic member (243) to rotate and store an auxiliary elastic potential energy to facilitate the curtain fabric (A) to be rolled up. When the user wants to reduce the force required to roll up the curtain fabric (A) according to the weight of the curtain fabric (A), the user can rotate the gear (247). The gear extension portion (2471) of the gear (247) pushes against the brake protruding portion (2461) of the brake elastic member (246) to release the brake elastic member (246) from the tail seat (3). After the brake elastic member (246) is released, if the user continues to rotate the gear (247), the gear extension portion (2471) will push the brake protruding portion (2461) to get contact with the second sleeve blocking portion (2451) of the second sleeve (245). The gear (247) drives the second sleeve (245) to rotate relative to the first sleeve (242) and the outer tube (21), so that the auxiliary elastic member (243) stores an auxiliary elastic potential energy. After releasing the gear (247), the second sleeve (245) may rotate in a direction opposite to the direction that the user rotates the gear (247) because the auxiliary elastic member (243) has a tendency to release the auxiliary elastic potential energy. However, after the second sleeve (245) is rotated, the second sleeve blocking portion (2451) will be pushed against the brake protruding portion (2461). The brake elastic member (246) is tightly fitted on the tail seat (3) again, and the adjusted auxiliary elastic member (243) can be retained to maintain the auxiliary elastic potential energy. When the curtain fabric (A) is to be rolled up, the auxiliary elastic member (243) will release the auxiliary elastic potential energy, so that the user can roll up the curtain fabric (A) with less force. Since the brake elastic member (246) is similar to the first elastic member (13) shown in FIG. 6, it is only briefly described herein.

Referring to FIG. 2 and FIG. 3, through the control device (1), when the curtain fabric (A) is in urgent need to be pulled down for hiding, the user only needs to energize the solenoid valve (12) by means of a remote control or a switch to disengage the front cap (15) from the engaging portion of the reeling mechanism (11), that is, the front cap (15) is disengaged from the inner cylinder (112) and the outer cylinder (113), thereby lowering the curtain fabric (A). There is no need for the user to approach the door/window where the curtain fabric (A) is located for operating the reeling wheel (111), reducing the risk of being discovered. After the curtain fabric (A) is lowered, the curtain fabric (A) can be restrained at an appropriate height by the limiting mechanism (23), preventing the strong impact force from damaging the roller blind when the curtain fabric (A) is lowered.

In the present invention, the operations of the limiting mechanism (23) and the adjustment mechanism (24) are designed at the same side, which is convenient for the user to adjust and operate.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A control device of a roller blind, comprising:

a reeling mechanism, having an engaging portion, the reeling mechanism including a reeling wheel, an inner cylinder and an outer cylinder, the reeling wheel has an action portion connected to the inner cylinder, the engaging portion including a first engaging portion disposed on the inner cylinder and a second engaging portion disposed on the outer cylinder;

a solenoid valve, disposed in the reeling mechanism;

a fixing seat, the solenoid valve being disposed in the fixing seat;

a push mechanism, movably disposed on the reeling mechanism, the push mechanism being connected with the solenoid valve;

a front cap, engaged with the engaging portion of the reeling mechanism, the front cap being connected with the push mechanism, the inner cylinder and the outer cylinder being detachably engaged with the front cap through the first engaging portion and the second engaging portion; and a damper, disposed in the reeling mechanism;

wherein after the solenoid valve is energized, the solenoid valve drives the push mechanism to push against the front cap so as to separate the front cap from the engaging portion, and the reeling mechanism is not subject to a resistance of the damper.

2. The control device of the roller blind as claimed in claim 1, wherein the damper is a first elastic member, the first elastic member is sleeved on the fixing seat, the first elastic member has a protruding portion, the action portion of the reeling wheel is an extension piece, the extension piece extends into the inner cylinder, the inner cylinder has a blocking portion corresponding to the extension piece, an operation space is defined between the blocking portion and the extension piece, the protruding portion of the first elastic member extends into the operation space, through the extension piece to push against the protruding portion of the first elastic member, the first elastic member can be released from the fixing seat.

3. The control device of the roller blind as claimed in claim 1, wherein the first engaging portion of the inner cylinder is a protrusion, and the protrusion is detachably engaged in an engaging groove of the front cap.

4. The control device of the roller blind as claimed in claim 1, wherein the second engaging portion of the outer cylinder is a plurality of raised blocks, and the plurality of raised blocks are detachably engaged with a plurality of engaging blocks of the front cap.

5. The control device of the roller blind as claimed in claim 2, wherein the push mechanism includes a shaft, a second elastic member and a screw, the second elastic member is disposed on the shaft, the shaft is connected with the solenoid valve, the shaft is locked to the front cap by the screw, the fixing seat has a retaining wall corresponding to the second elastic member; when the solenoid valve is energized, the shaft is controlled to extend out, so that the front cap is pushed by the shaft to be separated from the reeling mechanism, and the second elastic member abuts against the retaining wall to be compressed and store an elastic potential energy; after the solenoid valve is powered off, the second elastic member releases the elastic potential energy to return the shaft, and the front cap is engaged with the reeling mechanism.

6. A roller blind, comprising:

a linkage assembly, including an outer tube connected with a curtain fabric; and a control device, disposed at one end of the outer tube and engaged with the outer tube, the control device comprising:

a reeling mechanism, having an engaging portion;

a solenoid valve, disposed in the reeling mechanism;

a push mechanism, movably disposed on the reeling mechanism, the push mechanism being connected with the solenoid valve;

a front cap, engaged with the engaging portion of the reeling mechanism, the front cap being connected with the push mechanism;

a damper, disposed in the reeling mechanism;

an outer rod disposed in the outer tube and a limiting mechanism disposed on the outer rod and engaged with the outer tube; and a tail seat disposed at another end of the outer tube, an inner rod being disposed in the tail seat, the inner rod being connected with the outer rod; when an operation portion of the inner rod is operated to rotate the inner rod, the inner rod drives the outer rod to rotate relative to the outer tube, so that a slider is rotationally moved on an inner tube to adjust a distance between the slider and the limiting seat, wherein the limiting mechanism includes the inner tube sleeved on one end of the outer rod, a slider and a limiting seat that are rotationally movable in the inner tube, the slider has a first threaded portion, the inner tube has a second threaded portion, the first threaded portion of the slider is meshed with the second threaded portion of the inner tube, the outer tube has a limiting rib located in a limiting portion of the slider, when the outer tube is rotated to lower the curtain fabric, the outer tube drives the slider to rotate and move on the inner tube along the limiting rib in cooperation with the second threaded portion; when the slider is pushed against the limiting seat, the slider drives the outer tube to stop rotating, wherein after the solenoid valve is energized, the solenoid valve drives the push mechanism to push against the front cap so as to separate the front cap from the engaging portion, and the reeling mechanism is not subject to a resistance of the damper to drive the outer tube to rotate so as to lower the curtain fabric, wherein the inner rod includes a first coupling member, a second coupling member is disposed on the tail seat, a return elastic member is sleeved on the inner rod; when the first coupling member of the inner rod is disengaged from the second coupling member of the tail seat by operating the operation portion, the return elastic member stores a return elastic potential energy, and the inner rod drives the outer rod to rotate relative to the outer tube; when the operation portion is released, the return elastic member releases the return elastic potential energy to return the inner rod, so that the first coupling member of the inner rod is engaged with the second coupling member.

7. The roller blind as claimed in claim 6, wherein the slider is a first slider, the limiting seat includes a second slider and a buffer elastic member, the buffer elastic member is disposed between the inner tube and the second slider; when the first slider is pushed against the second slider, the buffer elastic member stores a buffer elastic potential energy, so that the second slider stops rotating; when the first slider is moved away from the second slider, the buffer elastic member releases the buffer elastic potential energy to return the second slider.

8. The roller blind as claimed in claim 6, wherein the slider has a first coupling portion, the limiting seat has a second coupling portion, when the slider is pushed against the limiting seat, the first coupling portion is coupled to the second coupling portion.

9. The roller blind as claimed in claim 6, wherein the second coupling member is coupled to the tail seat by a C-shaped retaining ring.

10. The roller blind as claimed in claim 6, further comprising a first sleeve disposed in the outer tube and engaged with the outer tube, a tail seat disposed at another end of the outer tube, an adjustment member and a second sleeve disposed on the tail seat, a brake elastic member sleeved on the tail seat, and an auxiliary elastic member connected to the first sleeve and the second sleeve; when the adjustment member is rotated, the adjustment member is pushed against a brake protruding portion of the brake elastic member so that the brake elastic member is released from the tail seat, the adjustment member drives the second sleeve to rotate relative to the first sleeve, and the auxiliary elastic member stores an auxiliary elastic potential energy; when the adjustment member stops rotating, the second sleeve is pushed against the brake protruding portion, and the brake elastic member is sleeved on the tail seat so that auxiliary elastic member maintains the auxiliary elastic potential energy.

* * * * *